US011540579B2

(12) United States Patent
Oliver

(10) Patent No.: US 11,540,579 B2
(45) Date of Patent: Jan. 3, 2023

(54) ENERGY DISSIPATING PROTECTIVE GEAR

(71) Applicant: VAULT PROTECTIVE INNOVATIONS, INC., Roanoke, VA (US)

(72) Inventor: Eric R. Oliver, Roanoke, VA (US)

(73) Assignee: VAULT PROTECTIVE INNOVATIONS, INC., Roanoke, VA (US)

( * ) Notice: Subject to any disclaimer, the term of this patent is extended or adjusted under 35 U.S.C. 154(b) by 0 days.

(21) Appl. No.: 17/521,202

(22) Filed: Nov. 8, 2021

(65) Prior Publication Data

US 2022/0142285 A1 May 12, 2022

Related U.S. Application Data

(60) Provisional application No. 63/132,700, filed on Dec. 31, 2020, provisional application No. 63/110,815, filed on Nov. 6, 2020.

(51) Int. Cl.
*A42B 3/06* (2006.01)

(52) U.S. Cl.
CPC ..... *A42B 3/062* (2013.01)

(58) Field of Classification Search
CPC ..... A42B 3/121; A42B 3/12; A42B 3/085; A42B 3/069; A42B 3/063; A42B 3/064;
(Continued)

(56) References Cited

U.S. PATENT DOCUMENTS 3,189,917 A * 6/1965 Sims ..... A63B 71/10 2/415
3,462,763 A * 8/1969 Schneider ..... A42B 3/12 2/413

(Continued)

FOREIGN PATENT DOCUMENTS

WO 9737553 A1 10/1997
WO 2016164653 A1 10/2016
WO 2017161143 A1 9/2017

OTHER PUBLICATIONS

PCT International Search Report issued to counterpart application No. PCT/US2021/058448 dated Feb. 17, 2022.

*Primary Examiner* — Katherine M Moran
(74) *Attorney, Agent, or Firm* — McNees Wallace & Nurick LLC

(57) ABSTRACT

A protective helmet includes an energy dissipative assembly including a conforming protective base adapted to directly contact and conform to a corresponding bony anatomical region of a wearer's head. A supported flexible suspended crown adapted to be affixed to the conforming protective base and configured to define a gap separating substantially all of the interior surface of the supported flexible suspended crown from contact with a corresponding anatomical crown region of the wearer when the helmet is donned by the wearer. The supported flexible suspended crown including at least one contoured flexible shell or a plurality of cantilevered members comprising a compliant energy dissipating material that, when impacted, undergoes deformation to an extent that is greater than deformation, when impacted, of the deformation resistant material of the conforming protective base. An uncoupled cantilevered posterior cranial shield system includes a yoke configured to attach to or be integrated with shoulder pads or another garment and an attenuating cantilevered arch attached to the yoke at first and
(Continued)

second emplacements, the attenuating cantilevered arch being configured to extend over a head of an individual wearing the shoulder pads or garment.

22 Claims, 21 Drawing Sheets

(58) Field of Classification Search
CPC .. A42B 3/14; A42B 3/32; A42B 3/322; A42B 3/324; A42B 3/346; A42B 3/328; A63B 71/10
See application file for complete search history.

(56) References Cited

U.S. PATENT DOCUMENTS 4,286,339 A * 9/1981 Coombs ..... A42B 3/14 2/416
4,825,476 A 5/1989 Andrews
4,999,855 A 3/1991 Brown
5,353,437 A 10/1994 Field et al.
5,546,609 A 8/1996 Rush, III
5,581,816 A 12/1996 Davis
6,006,368 A 12/1999 Phillips
6,378,140 B1 4/2002 Abraham et al.
6,385,781 B1 5/2002 Rose et al.
6,874,170 B1 4/2005 Aaron
7,062,795 B2 6/2006 Skiba et al.
9,238,167 B2 1/2016 Monica
9,603,405 B2 3/2017 Blecherman et al.
9,642,409 B2 * 5/2017 Roesler ..... A42B 3/06
9,750,297 B1 * 9/2017 Mini Townson ..... A42B 3/064
10,016,006 B2 7/2018 Popejoy
10,426,212 B1 10/2019 Ratliff
2005/0166303 A1 8/2005 Aaron
2007/0157370 A1 * 7/2007 Joubert Des Ouches ..... A42B 3/06 2/410
2010/0088808 A1 4/2010 Rietdyk et al.
2011/0277225 A1 11/2011 Salkind et al.
2012/0233745 A1 * 9/2012 Veazie ..... A42B 3/064 2/413
2013/0031706 A1 2/2013 Cooksey
2013/0061371 A1 * 3/2013 Phipps ..... A42B 3/064 2/411
2013/0205480 A1 8/2013 Nagely
2013/0340146 A1 * 12/2013 Dekker ..... A42B 3/324 2/411
2014/0020161 A1 1/2014 Mason
2014/0109305 A1 4/2014 Kerr
2014/0237707 A1 8/2014 Lane
2015/0113718 A1 4/2015 Bayer
2015/0313307 A1 * 11/2015 Wirthenstaetter ..... A63B 71/10 2/425
2017/0035137 A1 2/2017 Blecherman et al.
2017/0065016 A1 3/2017 Chuback et al.
2017/0251742 A1 9/2017 Partlo
2017/0367427 A1 12/2017 Meade
2018/0192728 A1 * 7/2018 Cleveland ..... A42B 3/127
2019/0082769 A1 3/2019 Barr
2019/0126127 A1 5/2019 Simpson
2019/0201775 A1 7/2019 Requa
2020/0015538 A1 1/2020 Bar-Cohen et al.
2020/0022443 A1 * 1/2020 Wetzel ..... A42B 3/121
2020/0154812 A1 1/2020 Harris et al.
2021/0153592 A1 * 5/2021 Esayian ..... A42B 3/00
2022/0023741 A1 * 1/2022 Oliver ..... A63B 71/10

* cited by examiner

ENERGY DISSIPATING PROTECTIVE GEAR

RELATED APPLICATIONS

This application claims priority to U.S. Provisional Patent Application Ser. No. 63/110,815, filed on Nov. 6, 2020, entitled UNCOUPLED CANTILEVERED POSTERIOR CRANIAL SHIELD, and U.S. Provisional Patent Application Ser. No. 63/132,700, filed on Dec. 31, 2020, entitled ENERGY DISSIPATING PROTECTIVE HEADGEAR, the entireties of which are incorporated herein by reference.

FIELD OF THE INVENTION

The present application describes an energy dissipating head protective system consisting of protective headgear that includes a conforming protective base that is supported on the head of a wearer, and a supported flexible suspended crown that is uncoupled from contact with the wearer's underlying head surface area. More particularly, the present application describes dependent compliant cranial shields supported by a sub-cranial foundation for use in collision sports and/or other physical endeavors.

BACKGROUND OF THE INVENTION

In recent years, scrutiny of American football player safety has intensified due to further elucidation that head impact exposures may increase risk of delayed neurologic and psychiatric dysfunction (NPD), including the neurodegenerative disease chronic traumatic encephalopathy (CTE). NPD and CTE symptoms include cognitive decline, impaired judgment, diminished impulse control, aggression, depression, anxiety, degraded motor function, and progressive dementia. No consensus has formed to define the aggregate football risk factors for chronic NPD and CTE due to study limitations and disparate findings; HOWEVER, it is universally accepted that advances in brain protection are essential for both short- and long-term player safety.

A concussion is a form of traumatic brain injury (TBI) that results when mechanical force transmission to the brain causes overt acute symptoms. The sudden accelerative/decelerative forces transmitted by an external impact are thought to structurally strain the brain as it "jostles" within the skull. Such forces are transferred to the brain resulting in damage to the neuronal tissue. Stretching of the neurons occur in response to these forces as the brain and its surrounding cerebrospinal fluid move in a delayed fashion. Stretching of the neuronal axons will disrupt their overall physiologic functioning and culminate in concussion symptoms. A sub concussive event occurs when the transmitted mechanical energy injures neurons by a similar mechanism, but the impact intensity does not exceed the severity threshold to instigate the cellular damage that causes overt symptoms (a sub-concussive sub-clinical injury).

While acute concussions inherently receive the most attention from the general public, the insidious, cumulative, sub-concussive repetitive head impacts (RHI) may pose an equal or greater risk in the development of delayed NPD/CTE. Repetitive sub-concussive hits may also introduce an independent mechanism for a concussion. Depending on the level of competition and position played, helmet accelerometer studies have demonstrated that football players may sustain 500 to 2,000 low-impact sub-concussive hits to the head during a typical football season. Investigators have diagnosed CTE in brains that have a history of RHI but lack a known history of concussion.

Youth football participation has significantly declined in recent years, due in large part to parental safety concerns regarding potential head and/or brain injuries. Canada has banned full-team youth football, starting in 2022. Members of five (5) state legislatures within the U.S. have introduced bills to ban tackle football for young players, and public sentiment/initiatives to translate such efforts into law will gain momentum with accumulation of corroborating evidence that early football participation is associated with NPD/CTE. Pediatric head and brain injuries related to sports is now firmly within the public health domain.

Innovation with respect to protective equipment for the head and brain in football has focused almost entirely on enhancement of the materials and properties of the contemporary helmet. The basic design of the modern football helmet consists of a hard polycarbonate plastic external shell, internal padding and cushioning, and an externally attached metal caged facemask. Other than incremental improvements in materials utilization, external shell strength/deformation properties, padding integrations, and overall aesthetics, this basic design has remained essentially unchanged for over a half-century; however, during this same period of time, players have become bigger, faster, and stronger, which translates to a concomitant increase in potential supraphysiological dynamic force exposure on the field of play.

Contemporary plastic shell football helmets have markedly reduced skull fractures compared to their pre-1950 leather predecessors, but they have offered limited benefits for concussion prevention. One study actually concluded that antiquated leather soft helmets provide the same concussive injury protection as modern helmets. Such a conclusion likely confirms that protective equipment applied as a single unit that directly contacts the surface area of the head simply is incapable of sufficiently attenuating the complex mechanical force transmission responsible for concussions. Most football head impacts are a complex combination of linear and rotational accelerative mechanical forces, which may cause an intense transient torsional strain on the brain and worsen with secondary rebound from the more compliant helmet components (i.e., foam lining that compresses upon impact and rebounds). As stated previously, concussive events are likely only one of several factors posing risks to long-term brain health in certain players, and the accumulation of sub-concussive hits/RHI may present an equal or greater risk.

Football concussions have relatively decreased over the last several years (although there was an increase within the NFL during the 2019 season), most likely due to a combination of modifications in practice methods/culture, coaching, officiating emphasis, tackling technique, and rules; however, despite such efforts and helmet technology improvements, the potential for a concussion persists due to the inability to eliminate the complex accelerative and rotational forces inherent in the high frequency collision sport that is American football. Therefore, there is a vital need for a new paradigm and/or solution for a sport that faces justifiable intensive scrutiny from a manifold cast of groups to include safety advocates, politicians, researchers, parents, and the players themselves. A profound advance in head and brain protection combined with effective exposure safety guidelines derived from high-quality research may provide a path to preserving football and other collision sports for younger players.

As noted above, in some instances, protective equipment applied exclusively to the head simply is incapable of sufficiently attenuating the complex mechanical force transmission responsible for concussions. Furthermore, the hard-shell helmets with foam linings do not provide ample dampening of the forces and may transfer greater forces to the brain tissue.

The following corollary from that conclusion most likely also applies: Protective equipment applied exclusively to the head is incapable of sufficiently attenuating and reducing the myriad of sub-concussive head impacts sustained in football and other collision sports. Most football head impacts are a combination of complex linear and rotational accelerative mechanical forces, which may cause an intense transient torsional strain on the brain and worsen with secondary rebound from the more compliant helmet components (i.e., foam lining that compresses upon impact and rebounds). As stated previously, concussive events are likely only one of several factors posing risks to long-term brain health in certain players, and the accumulation of sub-concussive hits/RHI may present an equal or greater risk. Repetitive sub-concussive hits to the player's head and/or body resulting in a subthreshold acceleration/deceleration force event to the skull and brain, is analogous to tissue fatigue. Tissue fatigue is due to long term repetitive cyclic loading at subthreshold forces that if applied one to two times to tissue may not induce short or long-term injury; however, if the subthreshold force is repetitively transferred to the tissue, the tissue will eventually suffer injury. In essence, where a single cycle of peak acceleration at threshold levels to tissue can cause injury after a single hit (i.e., concussions can occur at thresholds exceeding at least 65 g to 70 g forces in adult athlete measurements) (Broglio™), repetitive forces to the skull and brain can occur after a series of repetitive forces at sub-concussive or subthreshold levels. It is well documented that fatigue of human tissue occur at significantly lower values than the static ultimate strength of the tissue. Fatigue failures in human tissue have been shown to occur at approximately 50-60% of the static ultimate failures through cadaveric testing. In essence, it will take less force to induce injury to the brain and neural tissue with repetitive loading (hits) to the head. There is an exponential correlation between force magnitude and repetitive cycles.

While helmets ostensibly reduce impact intensity or the overall force transmission ultimately absorbed by the brain soft tissue itself, no current head protective system offers a practical means to reduce RHI frequency. Therefore, not only is added protection needed to supplement the helmet protection, but there is a vital need for a new option and/or solution for a sport that faces justifiable intensive scrutiny from a manifold cast of groups to include safety advocates, politicians, researchers, parents, and the players themselves.

Football concussions have relatively decreased over the last several years (although there was an increase within the NFL during the 2019 season), most likely due to a combination of modifications in practice methods/culture, coaching, officiating emphasis, tackling technique, and rules; however, despite such efforts and helmet technology improvements, the potential for a concussion persists due to the inability to eliminate the complex accelerative and rotational forces inherent in the high frequency collision sport that is American football. Principal among the significant rules modifications implemented over the last decade is the penalty "targeting," which, at the collegiate level, results in disqualification of a player initiating and engaging in helmet-to-helmet contact. Despite best efforts by players, the high-speed dynamic nature and action of the game does not permit complete elimination of such helmet-to-helmet contacts, and unintentional/unavoidable head-to-head collisions are inevitable.

Protective headgear having one or more improvements in comparison to the prior art would be desirable in the art. In addition, there is a vital need for a new option and/or solution for a sport that faces justifiable intensive scrutiny from a manifold cast of groups to include safety advocates, politicians, researchers, parents, and the players themselves. Players would benefit from a more comprehensive head protective system that decreases the probability and frequency of unintentional (and intentional) direct helmet-to-helmet contacts. A profound advance in head and brain protection combined with effective exposure safety guidelines derived from high-quality research may provide a path to preserving football and other collision sports for younger players.

SUMMARY OF THE INVENTION

In an embodiment, the protective headgear includes an energy dissipative assembly including a conforming protective base adapted to directly contact and conform to a corresponding bony anatomical region of a wearer's head, wherein the bony anatomical region is defined by frontal, left and right zygomatic, left and right temporal and occipital skull bones. the conforming protective base includes at least one rigid frontal segment, rigid left and right side segments, and at least one rigid occipital segment, each segment including a deformation resistant material. the conforming protective base supports the protective headgear on the wearer's head when donned such that energy from an impact applied to a cantilevered portion of the at least one cantilevered member of the protective headgear crown arrangement is dissipated, at least partially, by deformation of the at least one cantilevered member, transmission through the at least one cantilevered member to the conforming protective base, or a combination thereof.

The protective headgear may further include a fixator for locking or locking and tensioning the conforming protective base when donned by the wearer.

The protective headgear further includes a supported flexible suspended crown having interior and exterior surfaces, an apex region, a frontal region extending generally forwardly and downwardly from the apex region, left and right side regions extending generally downwardly and laterally from the apex region, and a rear region extending generally rearwardly and downwardly from the apex region, the supported flexible suspended crown adapted to be affixed to the conforming protective base via a fixation element, and configured to define a gap separating substantially all of the interior surface of the supported flexible suspended crown from contact with a corresponding anatomical crown region of the wearer when the protective headgear is donned by the wearer, wherein the anatomical crown region is defined by frontal, parietal, left and right sphenoid, left and right temporal, and occipital skull bones, the supported flexible suspended crown including at least one contoured flexible shell including a compliant energy dissipating material that, when impacted, undergoes deformation to an extent that is greater than deformation, when impacted, of the deformation resistant material of the conforming protective base.

In another embodiment, a protective headgear including a conforming protective base adapted to directly contact and conform to a corresponding bony anatomical region of a wearer's head. The bony anatomical region is defined by frontal, left and right zygomatic, left and right temporal and occipital skull bones. A protective headgear crown arrangement connected at one end to the conforming protective base, the protective headgear crown arrangement extending to at least one cantilevered member; the at least one cantilevered member adapted to define at least a portion of a crown corresponding to but separated by a predetermined distance from a corresponding anatomical crown region of the wearer when the protective headgear is donned by the wearer, wherein the anatomical crown region is defined by frontal, parietal, left and right sphenoid, left and right temporal, and occipital skull bones.

In a further embodiment, a protective headgear includes a conforming protective base adapted to directly contact and conform to a corresponding bony anatomical region of a wearer's head. The bony anatomical region is defined by frontal, left and right zygomatic, left and right temporal and occipital skull bones. A protective headgear crown arrangement connected at one end to the conforming protective base, the protective headgear crown arrangement extending to a plurality of cantilevered members; at least one of the plurality of cantilevered members forming the crown arrangement being complementarily contoured and spaced away by a predetermined distance from a corresponding anatomical crown region of the wearer when the protective headgear is donned by the wearer. The anatomical crown region is defined by frontal, parietal, left and right sphenoid, left and right temporal, and occipital skull bones.

In a further embodiment, a protective headgear includes a one or a combination of: a harness system affixed to the conforming protective base and spaced away from the protective headgear crown arrangement, the harness system including at least one contoured band that contact the wearer's head when the protective headgear is donned; and at least one intermediate head covering including one or both of a hard shell and a cushion spaced away from the protective headgear crown arrangement, the at least one intermediate head covering protectively covering at least a portion of the anatomical crown region of the wearer when donned.

The disclosure also provides protective gear that is not affixed to the head. In an exemplary embodiment, an uncoupled cantilevered posterior cranial shield system includes a posterior securement housing 120 connected to the posterior-superior aspect of athletic shoulder pads or integrated with the athletic shoulder pads and a force attenuating cantilevered arch 130 whose base is attached to the securement housing 120 at a first emplacement and a second emplacement, the attenuating cantilevered arch 130 being configured to extend over a head of an individual wearing the athletic shoulder pads. The attenuating cantilevered arch 130 is free of force communicating persistent connection to a head of the individual other than indirectly through the athletic shoulder pads.

The uncoupled cantilevered posterior cranial shield system is essentially a segmentation/partitioning of a conventional helmet such that the central front, top, and rear of the helmet's external protective shell is connected to the upper back and/or shoulders. This uncoupling of the armament's exclusive attachment from the head to alternative anatomical regions intercepts and conducts forces directed at the head to much less vulnerable robust non-cranial musculoskeletal structures.

BRIEF DESCRIPTION OF THE DRAWINGS

Other features and advantages of the present invention will be apparent from the following more detailed description, taken in conjunction with the accompanying drawings which illustrate, by way of example, the principles of the invention.

The figures present various views, according to various embodiments of the disclosure.

Figure 1:
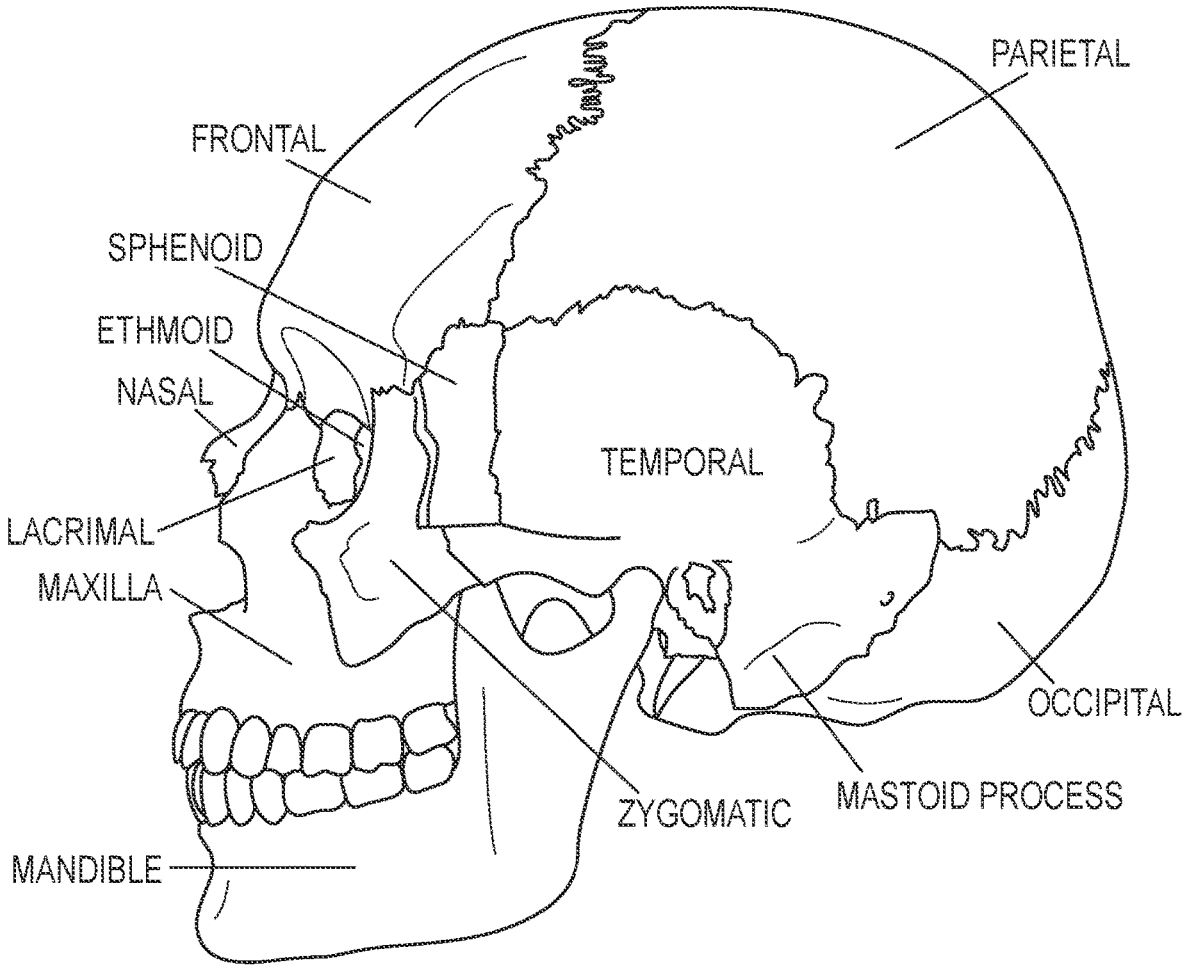
FIG. 1 is a side elevation view of a human skull.

This disclosure describes exemplary embodiments in accordance with the general inventive concepts and is not intended to limit the scope of the invention in any way. Indeed, the invention as described in the specification is broader than and unlimited by the exemplary embodiments set forth herein, and the terms used herein have their full ordinary meaning.

Key to Reference Numerals used in the Drawings, Table 1 (parenthetical numbers represent related features, and numbers that are preceded by "F" represent examples of drawings that include the feature):

10 protective headgear F3
11 wearer F3
12 energy dissipative assembly
13 foundation zone F2
14 the conforming protective base F3
16 bony anatomical region
17 padding component
18 rigid frontal segment (14) F3
20 rigid left side segment (14) F3
22 rigid right side segment (14) F3
24 rigid occipital segment (14) F3
26 fixator
27 latch
28 supported flexible suspended crown (10) F3
30 interior surface (28) F3
32 exterior surface (28) F3
34 apex region (28) F3
36 frontal region (28) F3
38 left side region (28) F3
38*a* left side region portion (88) F11
38*b* left side region portion (88) F11
40 right side region (28) F5
42 rear region (28) F3
44 gap (28, 11) F3
46 anatomical crown region (11) F3
48 contoured flexible shell (28) F3
50 discontinuity (14) F3
52 dissipator (14, 56) F4
56 (plurality of) contoured bands (28) F4
62 harness system (56) F4
66 open position (26) F5
68 closed position (26) F5
70 cantilevered members
71 break
72 impact F7
73 fixed end
74 dissipated force (72) F7
76 cantilevered end (36, 38, 42) F8A
78 deflection zone (58) F7
80 local deformation F9A
82 chin strap F4
84 fore guard F4
86 visor F4

88 protective headgear crown arrangement F9
89 central cantilevered member
90 protective headgear crown arrangement F12
91 central posterior aspect
92 intermediate head covering F12
94 conforming padded shell F12
95 flexible skin F12
96 cushions (94) F12
100 uncoupled cantilevered posterior cranial shield system
110 support garment
120 securement housing
122 securement extension
124 insertion elements
130 attenuating cantilevered arch
132 anterior edge
134 frontal shield portion
136 parietal shield portion
138 occipital/neck shield portion
142 visor shield, lateral
144 visor shield, frontal Generally, the same reference numbers will be used throughout the drawings to represent the same parts.

DETAILED DESCRIPTION OF THE INVENTION

The described embodiments and representative drawings are provided in the context of protective gear for wear in the context of football or American football. It will be appreciated by one of ordinary skill in the art that protective gear that is suitable for a sport or activity other than football may vary, and, thus, the protective gear, as shown variously in the drawings, may be varied in shape and other features to be more suitable for donning by a wearer other than an American football player. Accordingly, the invention hereof contemplates embodiments that are suited for providing protection to the head of a wearer for activities and other sports, such that the described and exemplified embodiments are not intended to be limiting.

As used herein, the terms "wearer," "wearer's head," "head" and the like are intended to be used interchangeably.

As shown in the figures and described herein, protective headgear, for example, in the context of American football, helmets, utilize novel arrangements to dissipate impacts directed to the cranial vault in order to reduce impact intensity. For example, as collectively shown in FIGS. 1 and 2, the paranasal sinuses of the maxillofacial skull have been designated the facial/head "crumple zone" with respect to facial traumatic injuries (provide a cushioning effect) and have been postulated as a critical built-in anatomic safety measure for maxillofacial trauma, and protective of the brain. Extending posteriorly (rearwardly) are the contiguous mandible, mastoid process, and lower occipital/high neck region. More specifically, as shown in FIG. 2, a support zone 13 encompasses these anatomical regions. Support zone 13 is inferior or below the brain within an area that may be described as a cranial vault as shown in FIG. 2 that houses the cerebral brain (supratentorial brain).

In the various embodiments, the features of the protective headgear 10 are designed to direct force associated with impacts to the headgear to anatomical features that are below the brain, i.e., sub-cranial, and at least in some embodiments, all or a portion of a lower edge of the portion of the headgear that covers a wearer's crown is sub-cranial, and in some specific and preferred embodiments, the portion of the headgear that covers a wearer's crown is formed of cantilevered segments, each of which is affixed to a generally rigid base portion that is donned and positioned to be worn on the wearer below the brain. As further described herein, in various embodiments, such rigid base portion is generally worn such that the majority of the base corresponds in position with the "crumple zone" as described above and is thus below the brain with the exception of the frontal portion which will be generally in line with the brain consistent with what is shown in the drawings.

Figure 2:
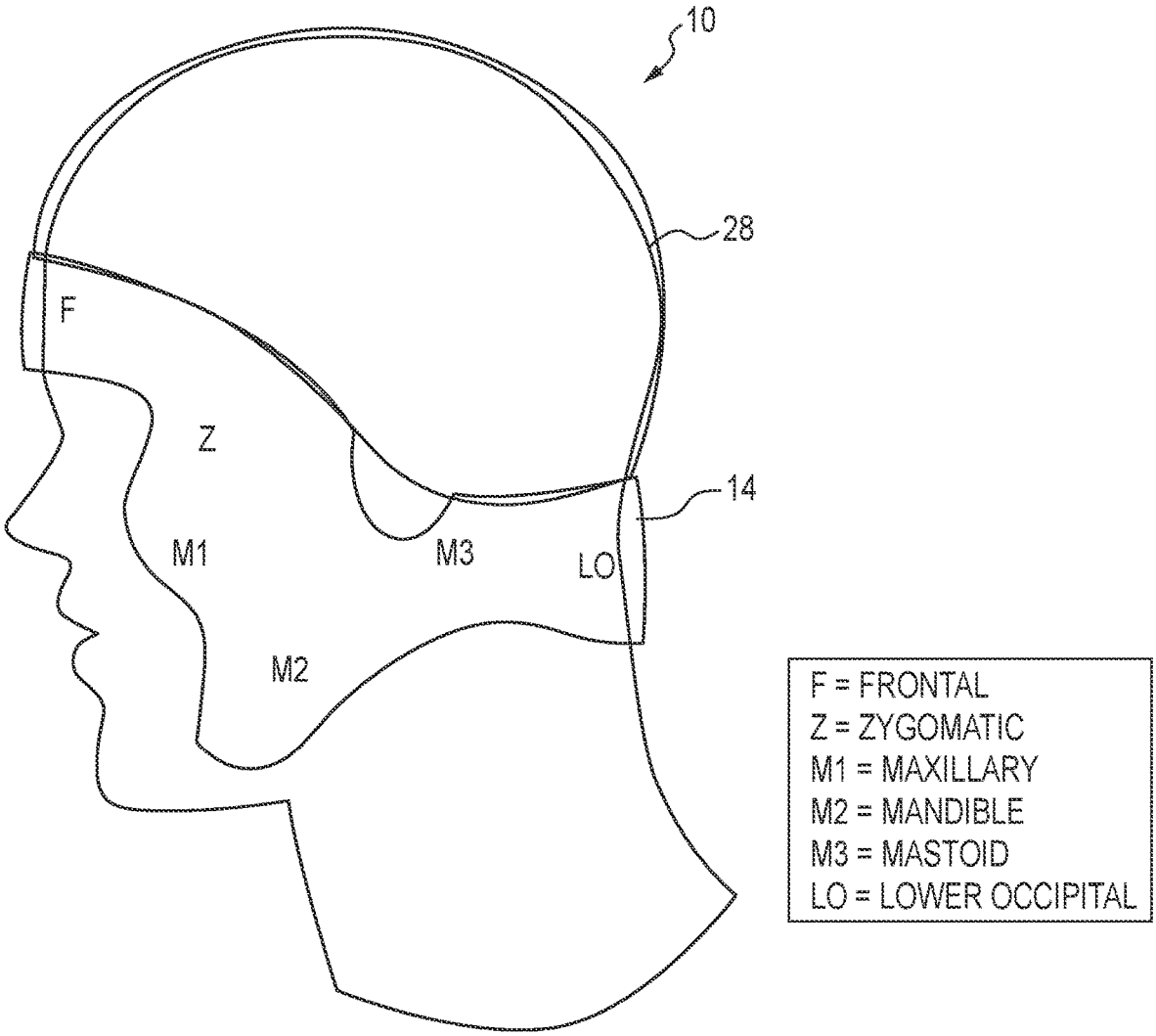
FIG. 2 is a schematic side elevation view of a wearer's head donning an exemplary the conforming protective base.
Figure 3:
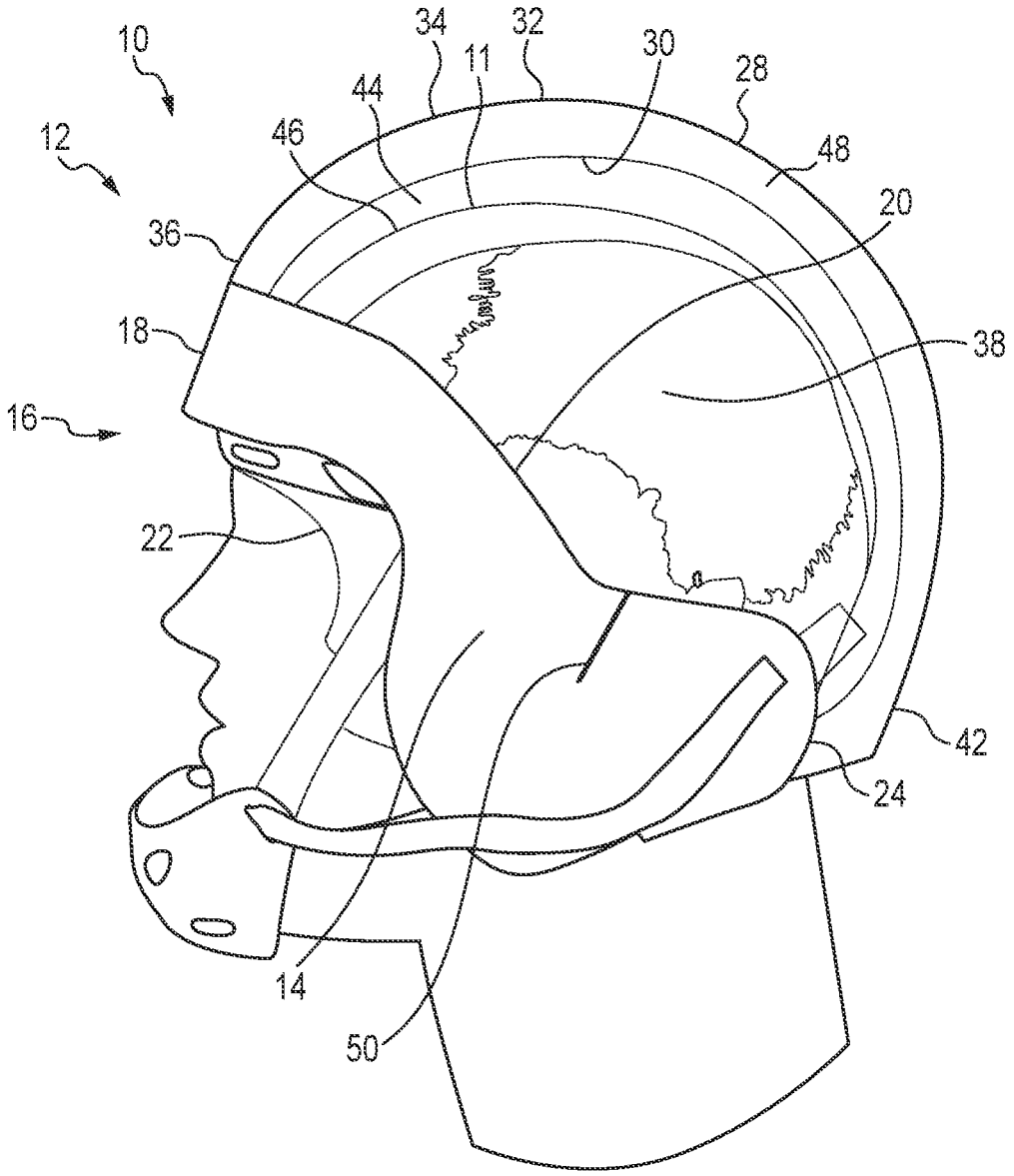
FIG. 3 is a side elevation view of an exemplary protective headgear donned on a wearer's head.
Figure 5A:
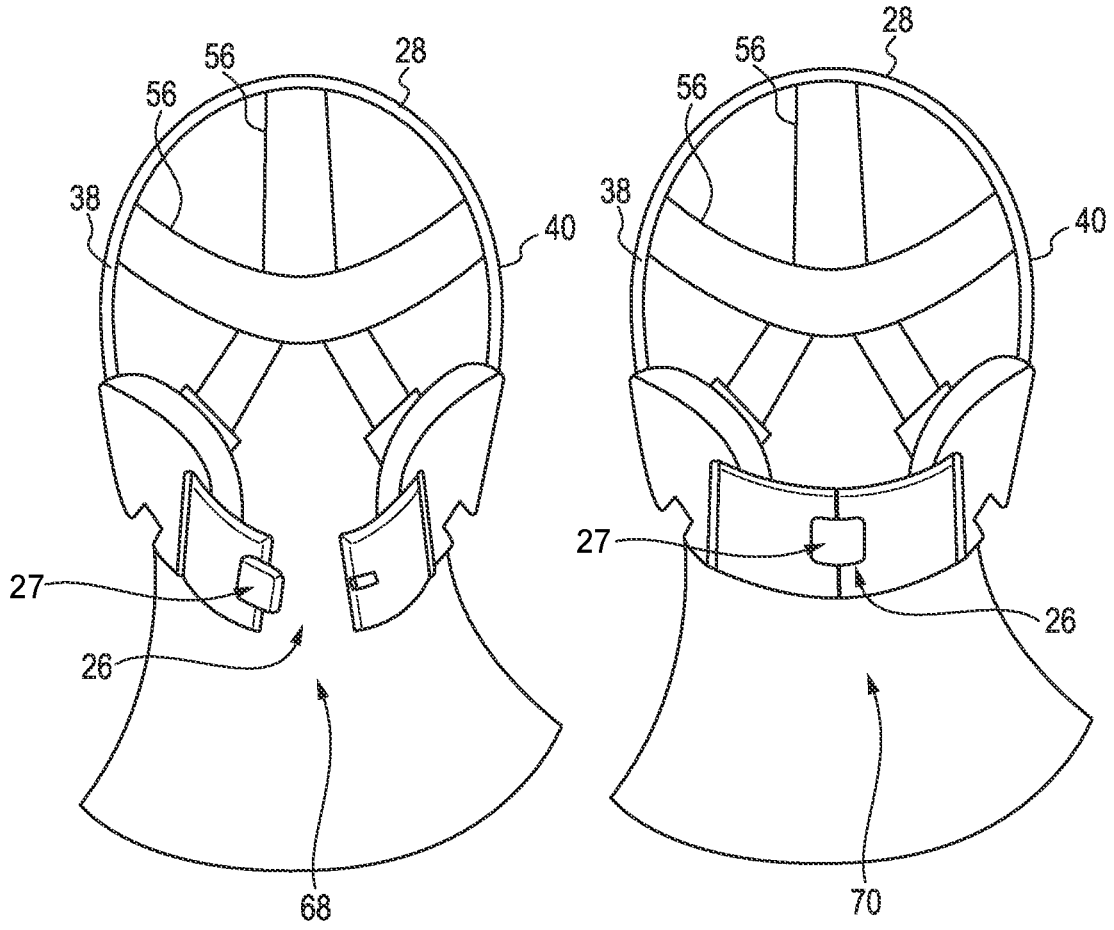
FIG. 5A is a rear elevation view of the conforming protective base of FIG. 2 shown with an exemplary fixator with a latch in an open, unengaged position and a closed, engaged position.
Figure 5B:
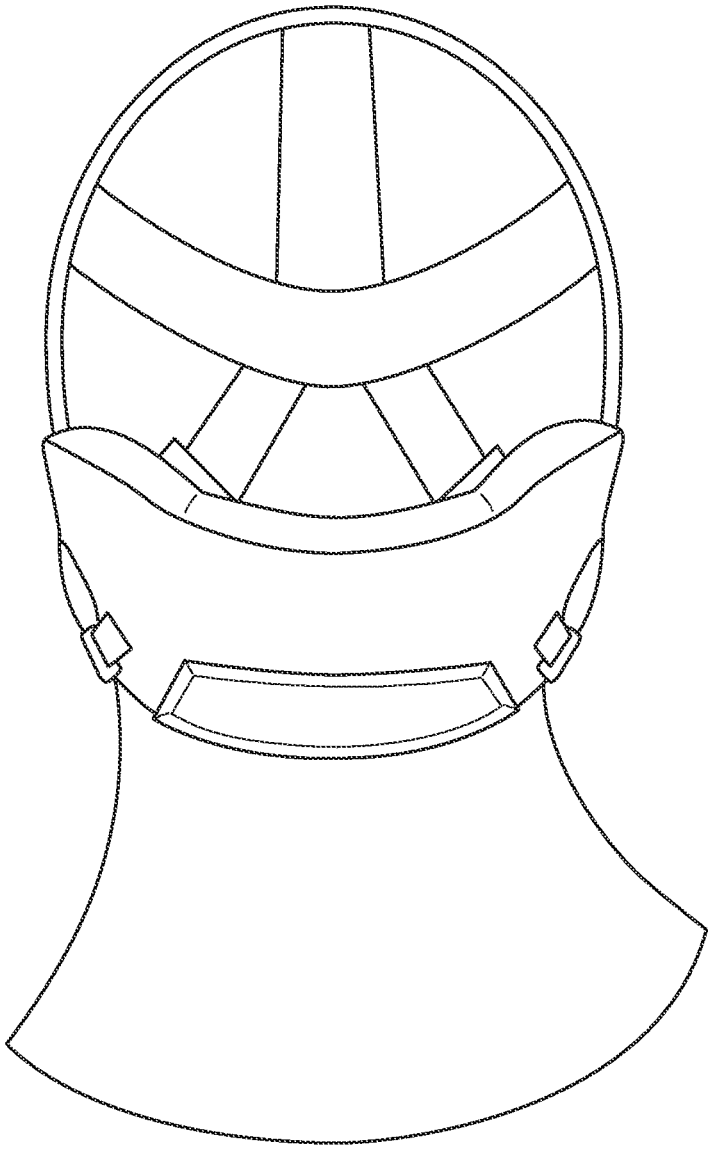
FIG. 5B is a rear elevation view of the conforming protective base of FIG. 2 shown with an alternate exemplary fixator that is contiguous with the conforming protective base and lacks an engagement feature.
Figure 10:
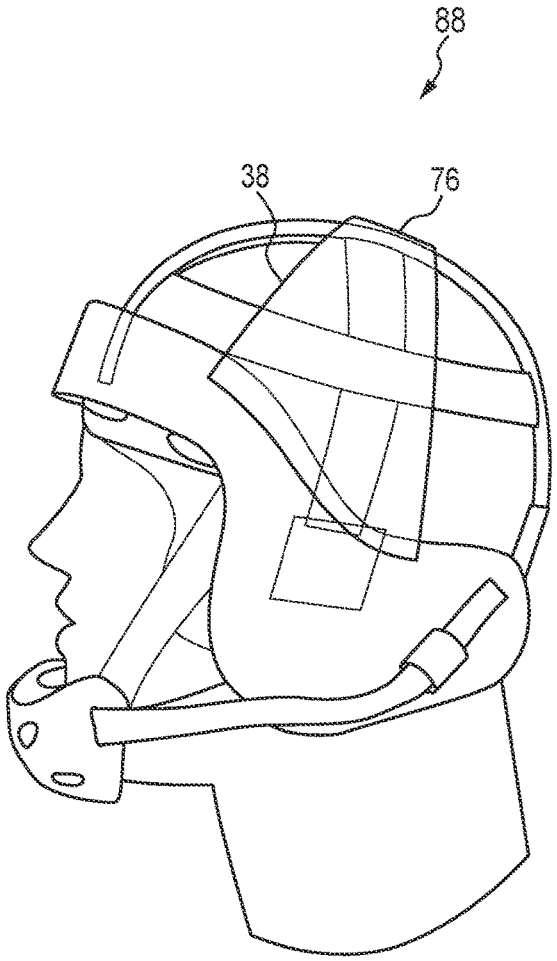
FIG. 10 is a side elevation view of an exemplary protective headgear donned on a wearer's head.
Figure 11:
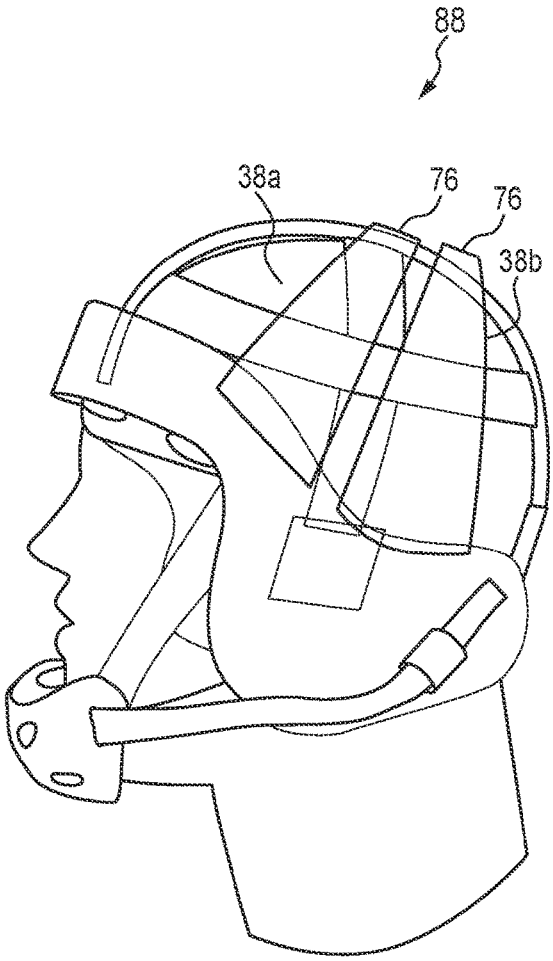
FIG. 11 is a side elevation view of an exemplary protective headgear donned on a wearer's head.

In some embodiments, as shown in FIG. 3, a protective headgear 10, such as a football helmet shown donned by a wearer 11, includes a conforming protective base 14 adapted to directly contact and conform to a corresponding bony anatomical region 16 of the wearer's head or support zone 13 (FIG. 2), in which the bony anatomical region 16 is defined by frontal, left and right zygomatic, left and right temporal and occipital skull bones, such as previously discussed in FIGS. 1 and 2. In some embodiments, as depicted in drawings, for example FIG. 8A, FIG. 9A and FIG. 9C, the protective headgear 10 may include a padding component 17 affixed or affixable to an interior surface of the conforming protective base 14, which padding component 17 contacts that wearer's head. the conforming protective base 14 comprises at least one rigid frontal segment 18, rigid left and right side segments 20, 22, and at least one rigid occipital segment 24, each segment comprising a deformation resistant material. the conforming protective base 14 serves as the overall protective headgear foundation. In one embodiment, the conforming protective base may include a plurality of at least one rigid frontal segment 18, rigid left and right side segments 20, 22, and at least one rigid occipital segment 24, such as may be arranged by extending generally vertically relative to one another, such as shown in FIGS. 10 and 11. As shown in FIG. 5A, the conforming protective base 14 includes a fixator 26, such as a latch 27 or other engagement features for locking or locking and tensioning corresponding portions of the conforming protective base 14 achieved by engaging corresponding engagement features to define the conforming protective base 14 in an engaged or closed position 68, wherein prior to such engagement, the corresponding disengaged engagement features defining a disengaged or open position 66. FIG. 5B shows an alternate embodiment of a conforming base where the fixator is contiguous with the conforming protective base and lacks an engagement feature.

In other embodiments, the confirming protective base 14 may not include a fixator whereby donning and securement on the head of the wearer is achieved without the need for any securement means. As further shown in FIG. 3, the conforming protective base 14 is continuous. In one embodiment, the conforming protective base 14 is one piece. In one embodiment, the conforming protective base 14 is formed from a single piece of material. In one embodiment, the conforming protective base 14 is formed from more than one piece of material that is secured together. In one embodiment, the conforming protective base 14 has at least one discontinuity 50 formed therein, such as a slit, groove, opening, protrusion, indentation or other feature formed therein. In one embodiment, at least one discontinuity 50 extends only partially through the conforming protective base 14. In one embodiment, at least one discontinuity 50 extends entirely through the conforming protective base 14. In one embodiment, at least one discontinuity 50 separates facing adjacent portions of the conforming protective base 14 from one another. In one embodiment, one or more discontinuity(ies) 14 may be positioned anywhere on or in the conforming protective base 14. According to such embodiments, the conforming protective base 14 may be donned and doffed by removal over a wearer's head from the front or possibly the rear of the wearer's head, depending on whether the discontinuity is located at the back, the front or a side of the confirming protective base 14. Of course, it will be appreciated that in some embodiments, such as shown in FIG. 5B, the conforming protective base 14 does not have any discontinuities and though it generally conforms to the anatomical features of a wearer's skull it does not fit snugly and is capable of being donned directly over the wearer's head without any fixation or other locking or latching mechanism. In yet other embodiments, the conforming protective base 14 may be retained on a wearer's head by attachment to a harness system 62, such as further described herein.

In some embodiments, as further shown in FIG. 3, protective headgear 10 includes a supported flexible suspended crown 28 having interior and exterior surfaces 30, 32, an apex region 34, a frontal region 36 extending generally forwardly and downwardly from the apex region 34, a left side region 38 and a right side region 40 (FIG. 5) each extending generally downwardly and laterally from the apex region 34, and a rear region 42 extending generally rearwardly and downwardly from the apex region 34. The supported flexible suspended crown 28 is adapted to be affixed to the conforming protective base 14 via a fixation element 15 such as by corresponding engagement features such as connections selected from a channel within or on a front or back surface and oriented along all or a portion of a length of the conforming protective base 14, or secured by flange/s or other suitable means involving rigid connecting members directly engaging one another, or intermediate components/connectors that directly or indirectly fix the portions together, or combinations thereof, for an engagement that may flexible, elastomeric; capable of crushing, sliding, collapsing, flexing, such engagement features may be formed of the same or different materials that vary in one or more of thickness, etc. That is, the engagement features associated with the supported flexible suspended crown may be flexible, elastomeric, capable of crushing, sliding, collapsing, flexing, and engagement features associated with the conforming protective base may be connected to facilitate relative movement in one or more planes—slidable, countersinking/reciprocating, or vice versa or combination thereof. In some embodiments, the supported flexible suspended crown 28 is affixed to the conforming protective base 14 via a fixation element 15 in a manner that is rigid so that a portion of the supported flexible suspended crown 28 that is contacted by a force deforms and bows at least at the point of contact to thereby direct the energy from the impact thorough the contacted portion of the supported flexible suspended crown 28 and into the conforming protective base 14. For example, as describe herein, flexion/bowing of a cantilevered member 70 directs force into the conforming protective base 14. In other possible embodiments, at least a portion of a supported flexible suspended crown 28 is affixed to the conforming protective base 14 via a fixation element 15 in a manner that permits reciprocation of the supported flexible suspended crown 28 relative to the conforming protective base 14 in response to an impact, the reciprocation achieved by operation of flexible dissipators or within a channel or flange that retains the supported flexible suspended crown 28 relative to the conforming protective base 14.

In other embodiments comprising a conforming protective base 14 and a supported flexible suspended crown 28, the conforming protective base 14 and supported flexible suspended crown 28 may be separate and affixable together and may, thus, be adapted to be independently donned in sequence by a wearer 11, the sequence including donning the conforming protective base 14 followed by donning the supported flexible suspended crown 28, each of the conforming protective base 14 and supported flexible suspended crown 28 comprising corresponding engagement features, such as previously discussed. In other embodiments, the conforming protective base 14 and supported flexible suspended crown 28 are affixed together and adapted to be donned as a unitary structure by a wearer 11. In different embodiments, the conforming protective base 14 and supported flexible suspended crown 28 may be formed of different materials, or the same material; may be unitary/monolithic (i.e., made of same material that is manipulated differently to have different response to impact) or assembled and made of same or different material.

In some embodiments, an energy dissipative assembly 12 comprises at least the combination of the conforming protective base 14 and a supported flexible suspended crown 28.

As further shown in FIG. 3, supported flexible suspended crown 28 and wearer 11 are configured to define a gap 44 separating substantially all of the interior surface 30 of the supported flexible suspended crown 28 from contact with a corresponding anatomical crown region 46 of the wearer 11 when the protective headgear 10 is donned by the wearer 11, wherein the anatomical crown region 46 is defined by frontal, parietal, left and right sphenoid, left and right temporal, and occipital skull bones, such as previously discussed and shown in FIG. 1. As further shown in FIG. 3, supported flexible suspended crown 14 comprises at least one contoured flexible shell 48 (FIG. 1 shows a single flexible shell) comprising a compliant energy dissipating material that, when impacted, undergoes deformation to an extent that is greater than deformation, when impacted, of the deformation resistant material of the conforming protective base.

As further shown in FIG. 3, the conforming protective base 14 supports the protective headgear on the wearer's head 11, when donned, such that energy from an impact to the supported flexible suspended crown 28 is dissipated, at least partially, by deformation of the contoured flexible shell 48 of the supported flexible suspended crown 28, transmission through the contoured flexible shell 48 to the conforming protective base 14, or a combination thereof.

In one embodiment, the contoured flexible shell 48 of the supported flexible suspended crown 28 is one piece, such as shown in FIG. 3.

Figure 4:
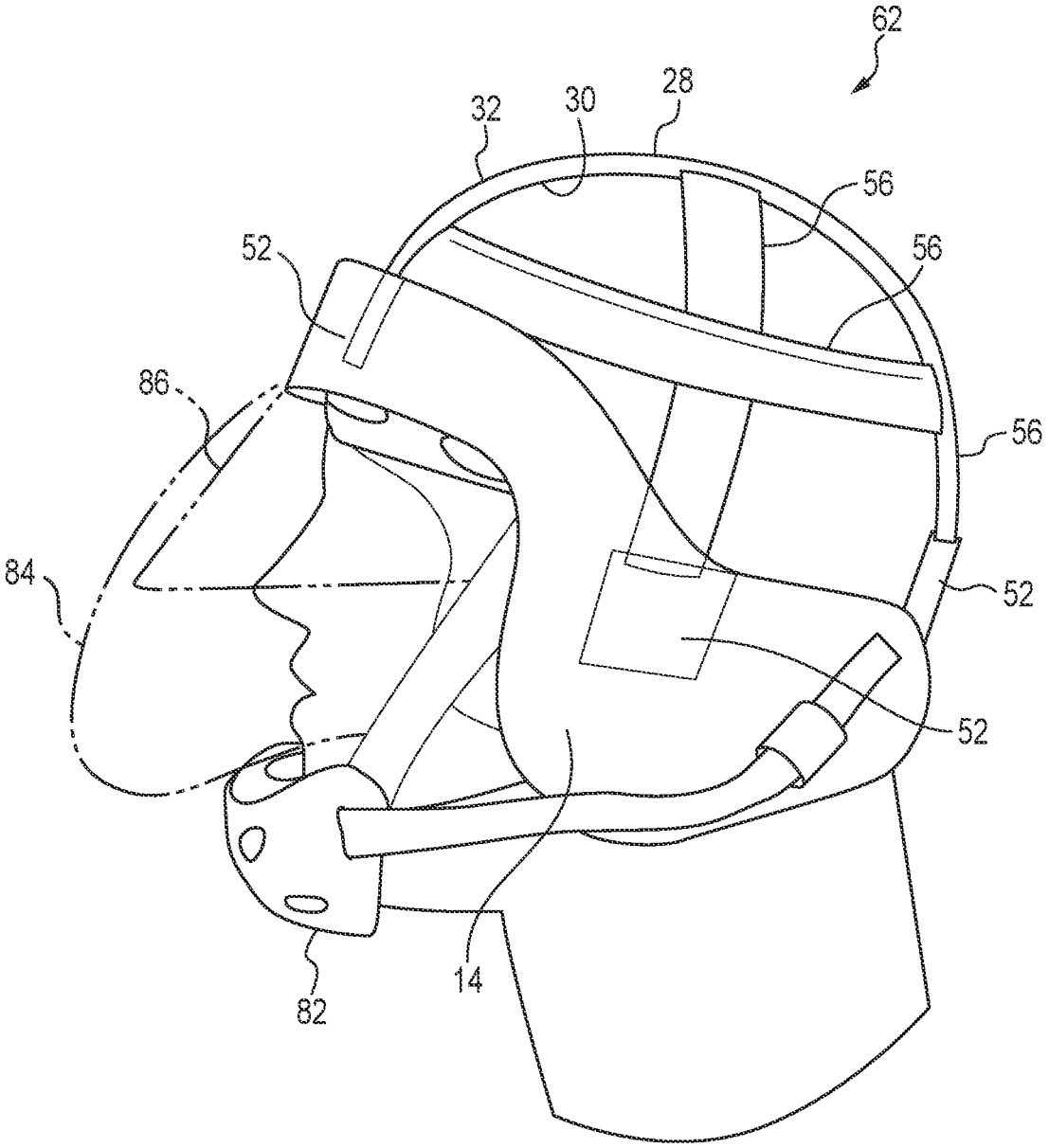
FIG. 4 is a side elevation view of an exemplary protective headgear donned on a wearer's head.

As shown in FIG. 4, supported flexible suspended crown 28 comprises a plurality of contoured bands 56. In one embodiment, at least one contoured band 56 moves independently of another contoured band 56. In one embodiment, at least one contoured band 56 is secured to another contoured band 56. As further shown in FIG. 4, optionally, at least one region affixing supported flexible suspended crown 28 to the conforming protective base 14 includes a dissipator 52, such as a resilient device acting as a shock absorber such as a spring/coil system, elastic material, similar force dissipating mechanism, or a combination thereof. The contoured bands 56 define a harness system 62 affixed to the conforming protective base 14, the harness system 62 comprising at least one contoured band 56 that contacts the wearer's head 11 when the protective headgear is donned. In some embodiments, the at least one contoured band 56 has elastic/elastomeric properties that allow the affixed the conforming protective base 14 to spring downward when an impact force is received by the protective headgear 10 to dissipate force. In some alternate embodiments, the at least one contoured band 56 is generally inflexible (i.e., is not elastomeric or flexibly deformable) and includes one or more dissipaters 52 that are elastically deformable and affix the at least one contoured band 56 that is flexible to the conforming protective base 14.

In other possible embodiments, it will be appreciated that alternate means of fixation may be employed. For example, a harness that includes bands, wherein one or more bands may be provided that tighten from front to back similar to a bike helmet suspension system, that suspends the conforming protective base 14 from bony structures along the path of the conformal band.

As further shown in FIG. 4, optionally, protective headgear 10 may include one or more of a chin strap 82, face guard 84, and visor 86.

Figure 6:
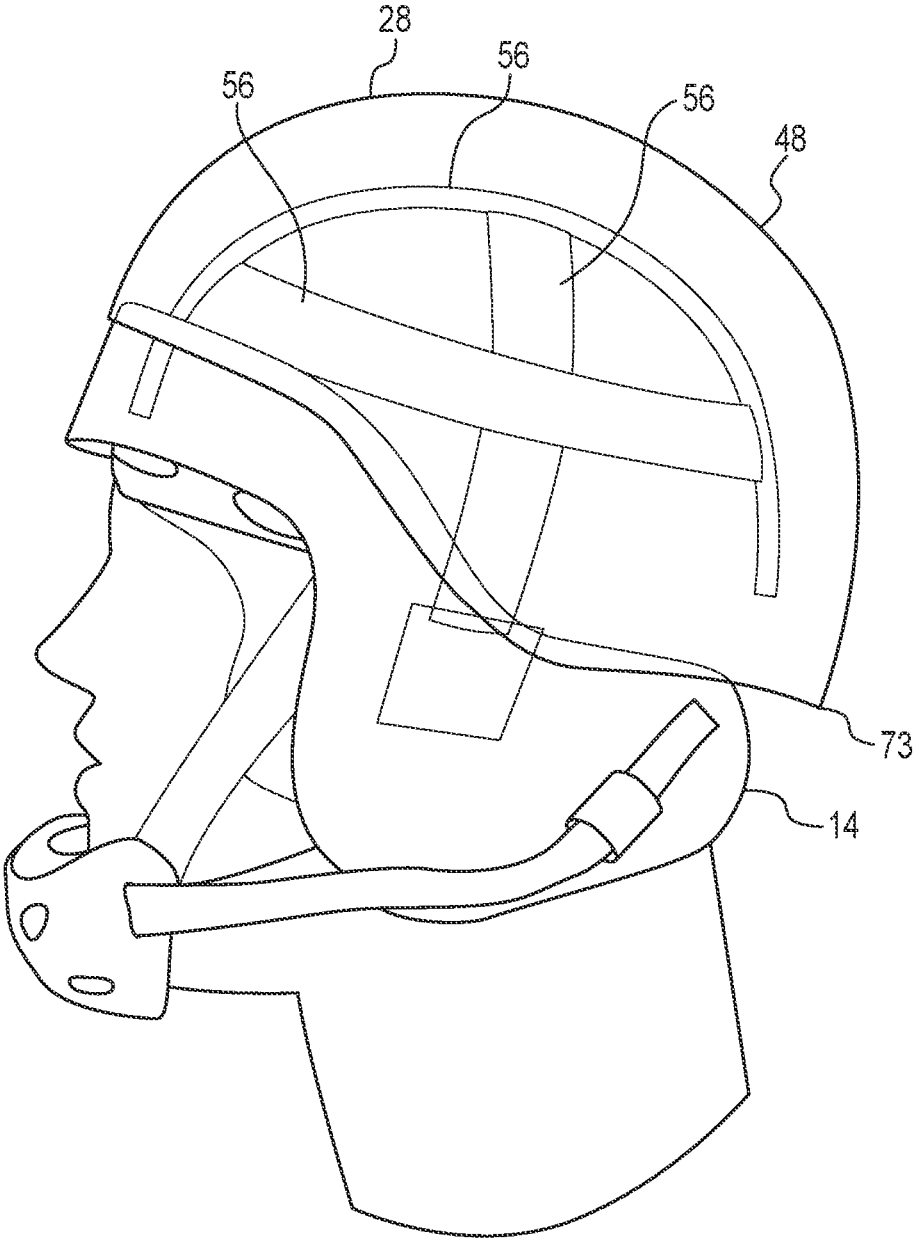
FIG. 6 is a side elevation view of an exemplary protective headgear donned on a wearer's head.

As shown in FIG. 6, in a first embodiment wherein the supported flexible suspended crown 28 is configured as a unitary part, the supported flexible suspended crown 28 comprises a unitary contoured flexible shell 48 that is secured or affixed at least discontinuously or continuously around its periphery to the conforming protective base 14, and is capable of one or both of deformation or reciprocation relative to the conforming protective base 14 to deflect and dissipate impact energy in contrast to the generally rigid and inflexible hard shells typically found on protective headgear outer surfaces. In other embodiments, as described in connection with FIG. 8-FIG. 11, the supported flexible suspended crown 28 is formed of a plurality of parts having one or more "breaks" formed between them to enable independent flexion and which form a supported flexible suspended crown 28 having one or more breaks or discontinuities.

Figure 7:
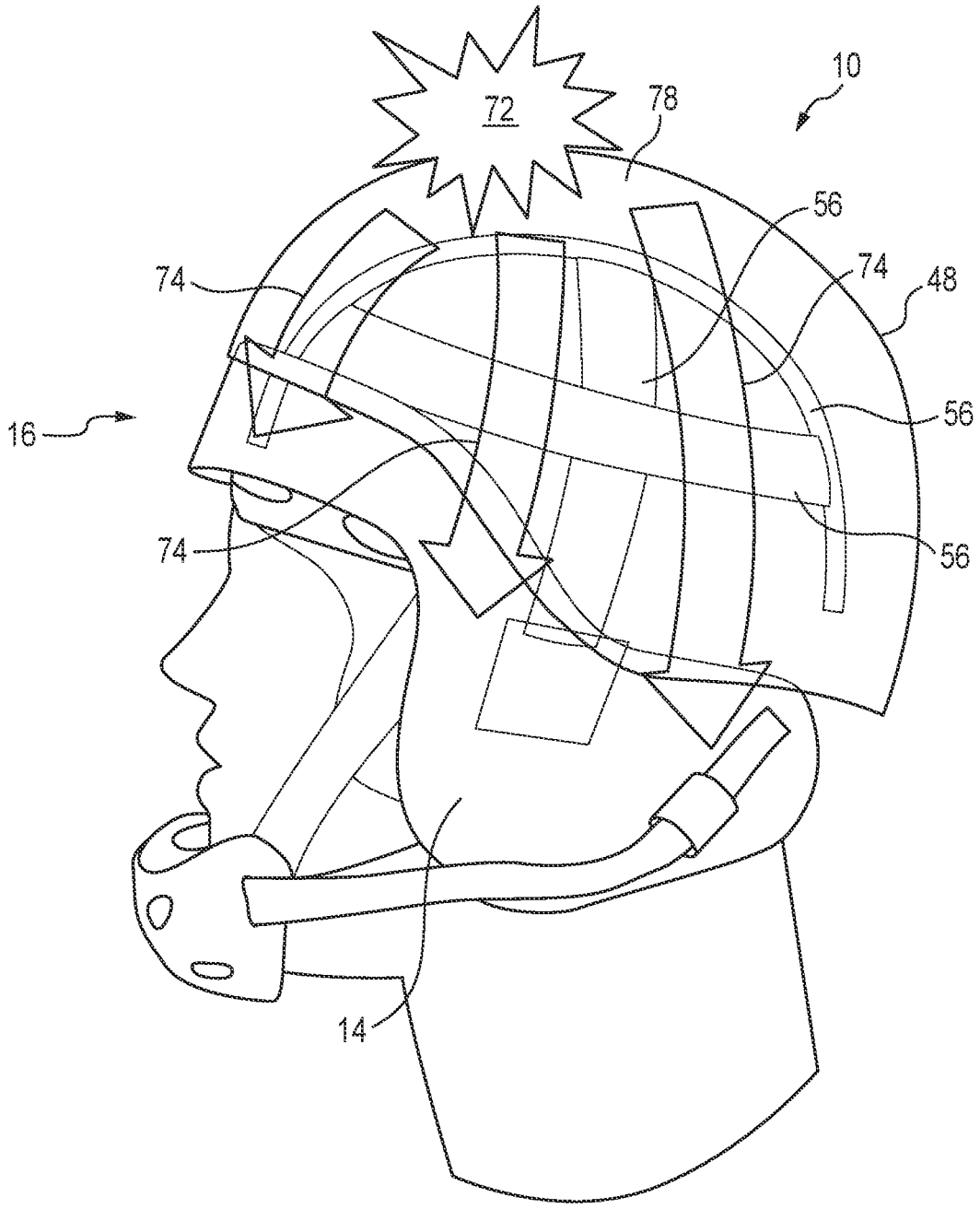
FIG. 7 is a side elevation view of the protective headgear of FIG. 6 subjected to an impact to a supported flexible suspended crown, and dissipation of said impact.

Referring again to FIG. 6, the contoured flexible shell 48, in response to an impact 72 defining a linear force applied in a direction to the cranial skull that houses the brain and corresponding to deflection zone (FIG. 7), this direct linear force that the protective headgear receives are now diverted/conducted (e.g., dissipated forces 74) to the conforming protective base 14 that is in direct contact with bony anatomical region 16 that is defined by frontal, left and right zygomatic, left and right temporal and occipital skull bones, such as previously discussed in FIGS. 1 and 2. Directing dissipated forces 74 to be transmitted through the conforming protective base 14 along anatomical region 16 is anatomically inherently more favorable/protective compared to impact 72 being directly provided to the cranial skull that houses the brain, as such dissipated forces 74 will be better mitigated by avoiding direct force transmission to the brain soft tissues.

Figure 8:
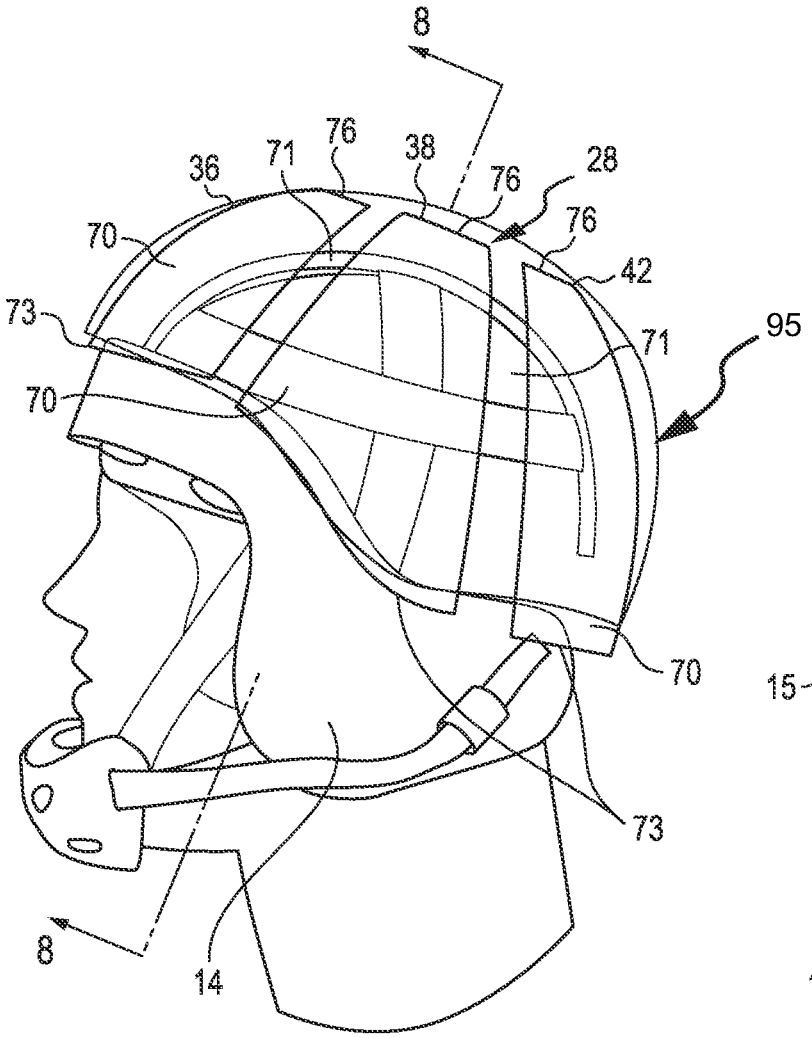
FIG. 8 is a side elevation view of an exemplary protective headgear donned on a wearer's head.

In an alternate and preferred embodiment, as exemplified in FIG. 8-FIG. 11, the supported flexible suspended crown 28 is formed of a plurality of cantilevered members 70 having one or more breaks 71 formed between them to enable independent flexion of each cantilevered member 70 and which form a supported flexible suspended crown 28. Each cantilevered member 70 includes a cantilevered end 76 which is not affixed to the conforming protective base 14 and is thus capable of flexion. According to such embodiments each cantilevered member 70 is capable of one or both of deformation or reciprocation relative to the conforming protective base 14 to deflect and dissipate impact energy in contrast to the generally rigid and inflexible hard shells typically found on protective headgear outer surfaces. Each of such cantilevered member 70 may be connected by or within a flexible membrane or flexible skin 95 that forms an overall continuous supported flexible suspended crown 28, wherein in some such embodiments, there may be two or more cantilevered member 70 that may be fully overlapping, partially overlapping, or non-overlapping or a combination thereof, all as further described herein. It will be appreciated that the flexible skin 95 need not be present in all embodiments. Generally, each cantilevered member 70 is formed of a material that enables it to flex and bend by generally elastic/elastomeric deformation, wherein a cantilevered member 70 is oriented to flex from its fixed end 73 at the conforming protective base 14 to its cantilevered end 76 that extends toward the apex region 34 of the supported flexible suspended crown 28, wherein at least in some embodiments, one or more of the cantilevered members 70 has a fixed end 73 that is positioned sub-cranial and wherein according to such embodiments that comprise a plurality of cantilevered members 70, for example as shown in FIG. 8, the cantilevered end 76 of each of the cantilevered members 70 converges toward the apex region 34.

In some embodiments, one or more of each cantilevered member 70 may be adapted to be affixed to the conforming protective base 14 via a fixation element 15, such as by corresponding engagement features such as connections selected from a channel within or on a front or back surface and oriented along all or a portion of a length of the conforming protective base 14, or secured by one or more flanges or other suitable means involving rigid connecting members directly engaging one another, or intermediate components/connectors such as rivets, permanent or releasable adhesive coatings or layers, or combinations thereof that directly or indirectly fix the conforming protective base 14 and a cantilevered member 70 together. In various embodiments, fixation between the conforming protective base 14 and a cantilevered member 70 may be accomplished by a fixation element 15 that permits engagement that may flexible, elastomeric, capable of crushing, sliding, collapsing, or flexing, and may comprise one or more fixation elements 15 formed of the same or different materials as compared to the materials of either of the conforming protective base 14 and a cantilevered member 70 wherein the materials may vary in one or more of thickness, durometer, material type for example plastic, elastomeric or rubber material, metal, or combinations thereof. That is, the engagement features comprising one or more fixation elements 15 associated with a cantilevered member 70 may be flexible, elastomeric, capable of crushing, sliding, collapsing, flexing, and engagement features associated with the conforming protective base 14 may be connected to facilitate relative movement in one or more planes—slidable, countersinking/reciprocating, or vice versa or combination thereof. In some embodiments, a cantilevered member 70 is affixed to the conforming protective base 14 via a fixation element 15 in a manner that is rigid so that a portion of a cantilevered member 70 that is contacted by a force deforms and bows at least at the point of contact to thereby direct the energy from the impact thorough the contacted portion of the cantilevered member 70 and into the conforming protective base 14. These described means of fixation to the conforming protective base 14 are generally applicable both to the supported flexible suspended crown 28 and to any one or more cantilevered members 70, or combinations thereof.

Figure 8A:
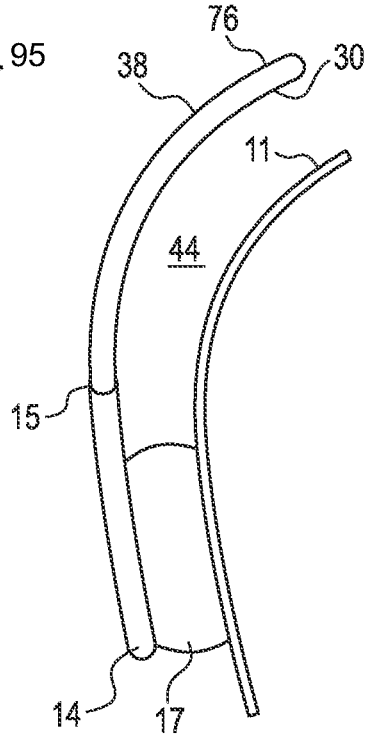
FIG. 8A is a cross section taken along line 8-8 of the wearer's head and the protective headgear of FIG. 8.

Referring again to the drawings, as shown collectively in FIGS. 8, 8A, supported flexible suspended crown 28, which includes a plurality of cantilevered members 70 each of them designated as separated frontal region 36, left side region 38, and rear region 42. In this embodiment, the cantilevered member 70 forming the frontal region 36, left side region 38, and rear region 42 are each secured or affixed at one end via a fixation element 15 to the conforming protective base 14. As further shown in FIG. 8A, which is a cross section taken along line 8-8 of FIG. 8, the cantilevered member 70 left side region 38 extends from the conforming protective base 14 to a cantilevered end 76, there being a gap 44 separating interior surface 30 of the cantilevered member 70 at left side region 38 (gap 44 also separating frontal region 36 and rear region 42 not shown in FIG. 8A). As shown in FIG. 8, each of the cantilevered member 70 of the frontal region 36, left side region 38, and rear region 42 which are each secured or affixed at one end via a fixation element 15 to the conforming protective base 14 and extends from the conforming protective base 14 to a respective cantilevered end 76.

Figure 9A:
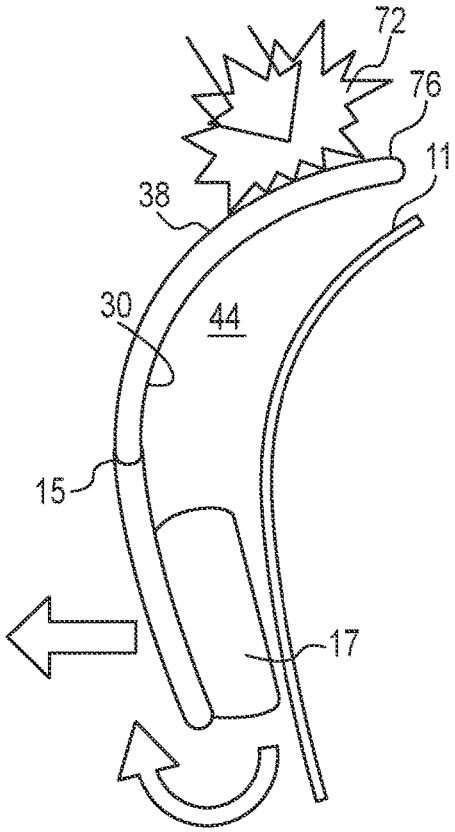
FIG. 9A is a side elevation view of the protective headgear of FIG. 8 subjected to an impact to a supported flexible suspended crown.
Figure 9B:
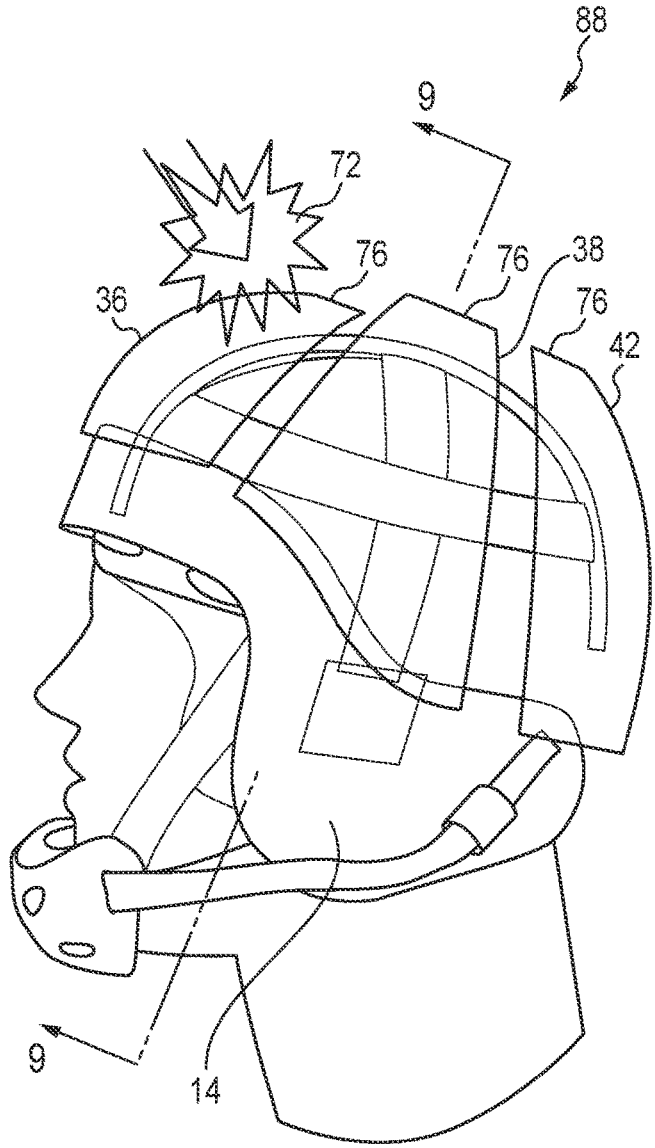
FIG. 9B is a cross section taken along line 9-9 of the wearer's head and the protective headgear of FIG. 9, as well as components of impact forces dissipated by the protective headgear.

Referring now to FIG. 9A and FIG. 9B, in response to being subjected to impact 72 that is within the dissipation performance specifications of the protective headgear 10, although there is at least local deformation of cantilevered end 76 of the cantilevered member 70 of the left side region 38 directing cantilevered end 76 toward wearer's head 11 and the distance between wearer's head 11 and the interior surface 30 of left side region 38 is reduced from that of gap 44 in an unstressed condition, at least a portion of the gap 44 is maintained to avoid direct contact and associated trauma between the wearer's head and the interior surface of left side region 38 (or any other region) subjected to an impact.

Figure 9C:
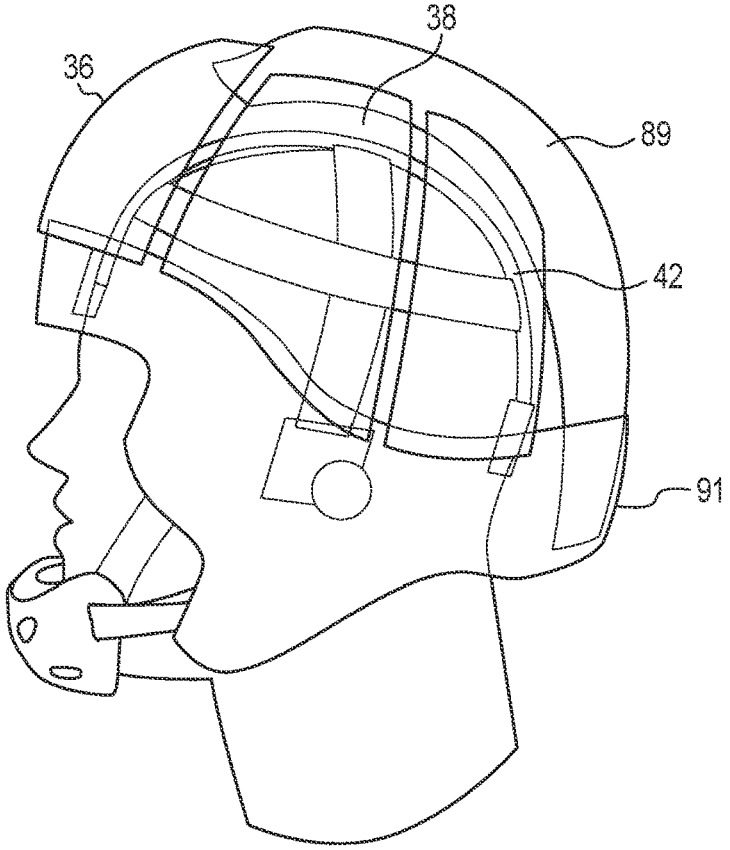
FIG. 9C is a side elevation view of an alternate embodiment of the protective headgear of FIG. 8 subjected to an impact to a supported flexible suspended crown.
Figure 9D:
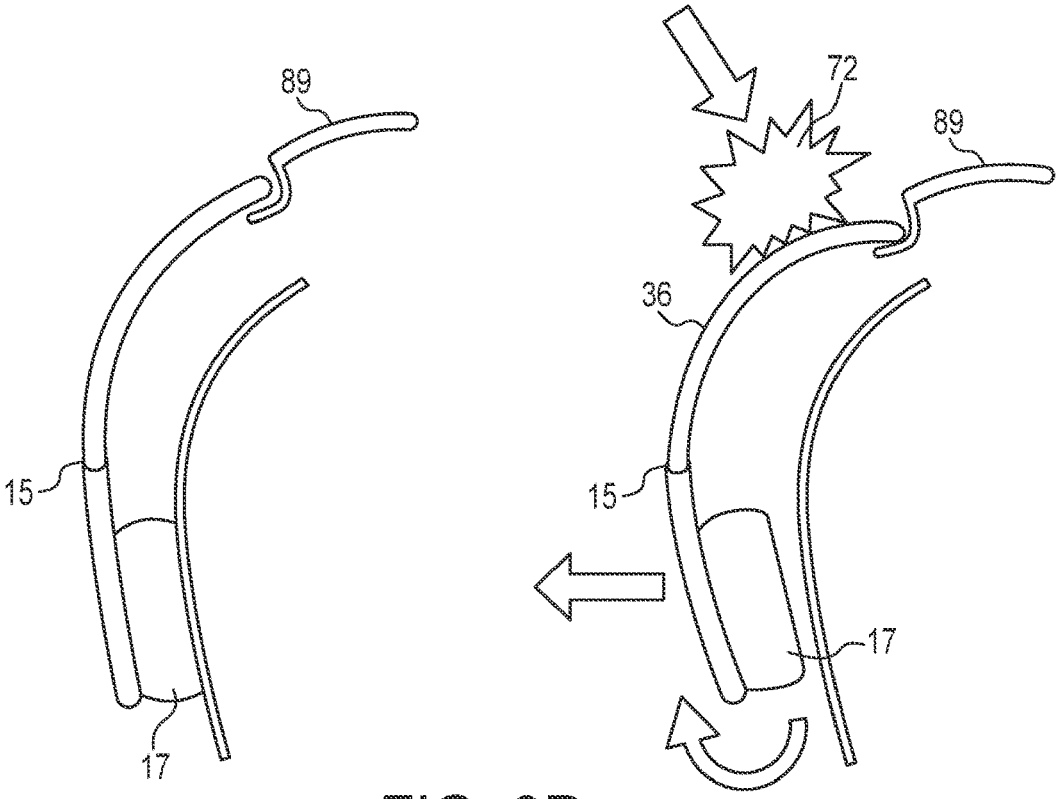
FIG. 9D is a cross section taken along line 9-9 of the wearer's head of an alternate embodiment of the protective headgear of FIG. 9, as well as components of impact forces dissipated by the protective headgear.

Referring now to FIG. 9C and FIG. 9D, in an alternate embodiment of the protective headgear 10 shown in FIGS. 8-9B, wherein the supported flexible suspended crown 28 includes cantilevered members 70 that overlap with at least one other cantilevered member 70, shown in the figure as central cantilevered member 89. As shown, central cantilevered member 89 is affixed via a fixation element 15 to a central posterior aspect 91 of the conforming protective base 14 and is designed to overlap with and cooperate with the frontal and lateral members 36, 38 and 42 to direct impact energy towards the central posterior aspect 91 of the conforming protective base 14. This central cantilevered member 89 serves as shielding protection of the midline and apex of the cranium of the wearer, as well as providing supplementary protection due to its engagement with the central posterior aspect 91 of the conforming protective base 14 when the frontal and lateral members 36, 38 and 42 deform after an impact.

As shown in FIGS. 10-11, the protective headgear crown arrangement 88 is modular, offering the flexibility to customize the configuration of the regions, as needed, to optionally include larger or smaller cantilevered members 70. For example, in FIG. 10, left side region 38 is shown to include a single member secured to the conforming protective base 14 having a first size that is relatively greater than the size of the cantilevered members 70 of left side region comprising 38*a*, 38*b*. In one embodiment, at least one or more of the frontal region 36, left side regions 38, right side regions 40, and a rear region 42 may be arranged in smaller subregions or combined in any combination into a larger region as appropriate.

Figure 12:
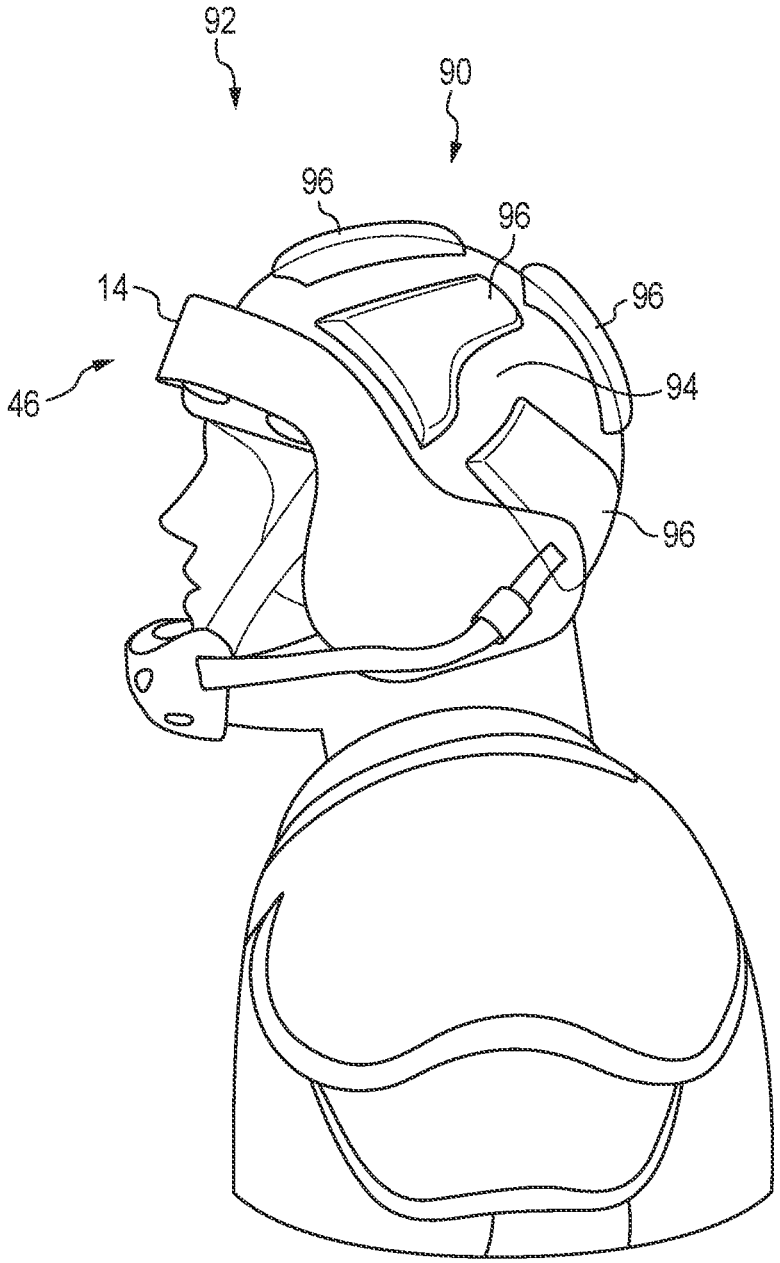
FIG. 12 is a side elevation view of an exemplary component of an embodiment of protective headgear donned on a wearer's head.
Figure 13A:
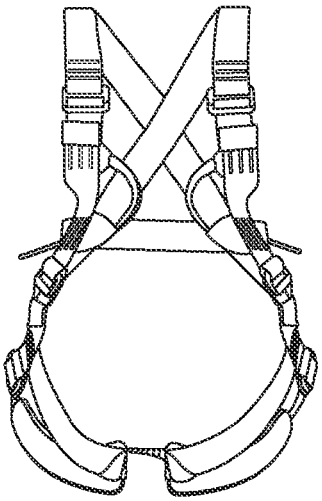
FIG. 13A shows a first representative and non-limiting embodiment of a support garment that may be selected for use in the uncoupled cantilevered posterior cranial shield system according to the disclosure.
Figure 13B:
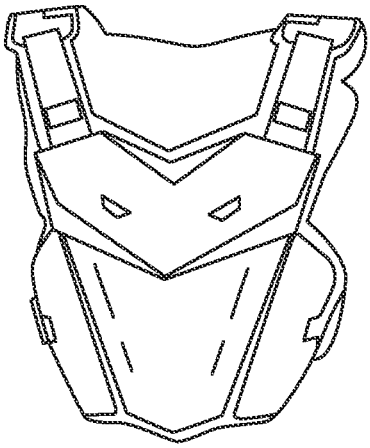
FIG. 13B shows a second representative and non-limiting embodiment of a support garment that may be selected for use in the uncoupled cantilevered posterior cranial shield system according to the disclosure.
Figure 13C:
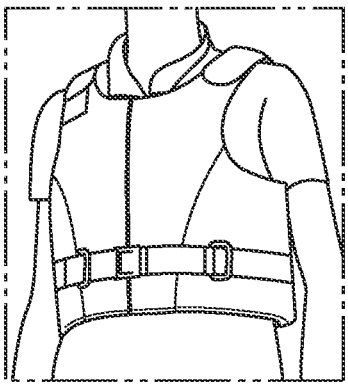
FIG. 13C shows a third representative and non-limiting embodiment of a support garment that may be selected for use in the uncoupled cantilevered posterior cranial shield system according to the disclosure.
Figure 13D:
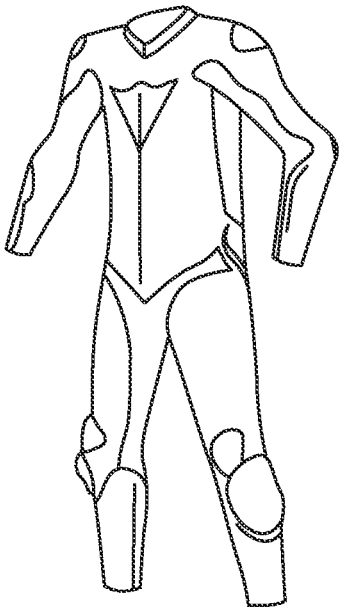
FIG. 13D shows a fourth representative and non-limiting embodiment of a support garment that may be selected for use in the uncoupled cantilevered posterior cranial shield system according to the disclosure.
Figure 13E:
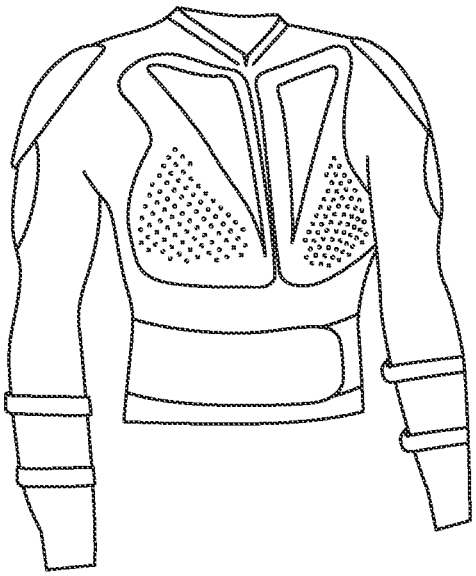
FIG. 13E shows a fifth representative and non-limiting embodiment of a support garment that may be selected for use in the uncoupled cantilevered posterior cranial shield system according to the disclosure.

As shown in FIG. 12, an embodiment of protective gear is shown that includes the conformable band 14 absent the supported flexible suspended crown 28 and depicting a an intermediate head covering 92 in the form of a conforming padded shell 94 extending over the wearer's anatomical crown region that may be donned separately or may be affixed via a fixation element 15 to the conforming protective base 14 along the periphery of the conforming padded shell 94. A plurality of cushions 96 extend outwardly from conforming padded shell 92 the placement, size and other features thereof selected to provide supplemental protection to a wearer's head for example to protect the wearer from contact with deforming components of the supported flexible suspended crown 28. Conforming padded shell 94 is in contact with a wearer's head when donned. This arrangement lacks a rigid helmet supported flexible suspended crown that is found on convention helmets and which is replaced by a supported flexible suspended crown 28 according to the disclosure, thereby offering the protection of padding directly on the head while taking advantage of the properties of the unitary and in particular the cantilevered segment embodiments of the supported flexible suspended crown 28 as described herein, thus also saving weight, and being more streamlined.

Uncoupled Cantilevered Posterior Cranial Shield

The present application also provides an uncoupled cantilevered posterior cranial shield that is not mounted to the head of the user. More particularly, the present application provides an uncoupled cantilevered posterior cranial shield system for use in collision sports and other endeavors requiring head protection which attenuates collision forces, either providing the primary protection, or augmenting and supplementing the protection offered by a helmet.

An uncoupled cantilevered posterior cranial shield system is disclosed including a yoke configured to attach to or be integrated with shoulder pads and an attenuating cantilevered arch attached to the yoke at first and second emplacements, the attenuating cantilevered arch being configured to extend over a head of an individual wearing the shoulder pads. The attenuating cantilevered arch is free of force communicating persistent connection to a head of the individual other than indirectly through the shoulder pads. Another floating lateral-vertical cranial shield is disclosed including an emplacement configured to attach to or be integrated with a helmet at a rearmost quarter of the helmet and at least one cantilever arc attached to the emplacement, the at least one cantilever arc being configured to extend toward the front of the helmet from the emplacement. The at least one cantilever arc is free of force communicating persistent connection to the helmet other than through the emplacement.

The uncoupled cantilevered posterior cranial shield system is provided for use in athletic endeavors requiring head protection, particularly where concussive and subconcussive repetitive head impacts are a concern. The system described herein offers a novel approach and an overall paradigm shift for head protection in football and other sports. As compared with current technology, the system according to this disclosure is designed to better protect the brain from the sub-clinical yet deleterious lower impact subconcussive hits and reduce the severity and intensity of certain higher impact collisions of the head region, while also conferring increased protection to the neck and spine.

The uncoupled cantilevered posterior cranial shield system further described herein can be further designated Helmet Auxiliary Armament Located Overhead (HAALO). The HAALO generally provides the structural features of a conventional head protector, such as a conventional football helmet, except that the sectioned crown/parietal/occipital helmet external shell component that has independent and uncoupled connectivity to the upper back/shoulder region rather than to the head of the wearer.

As stated previously, in the backdrop of emerging research that establishes long-term accumulation of subconcussive repetitive head impacts as a risk factor for delayed adverse neurologic and/or psychiatric consequences in susceptible individuals, the development and cultivation of a more comprehensive head and brain protective system to mitigate and reduce subconcussive repetitive head impacts is imperative for long-term player safety and football sustainability/viability. Such a goal can be achieved by either fundamentally altering the established physical nature of football through radical rules changes (or simply eliminating the game), or fundamentally improving the protective equipment primarily responsible for protecting the head. This system aims to achieve a radical reduction in impacts to the head by providing a novel impact energy system that alters the paradigm of head protection for football and other sports by providing diversion, deflection, dissipation, distribution, and decreased friction of impact energy.

The primary advantage of the uncoupled cantilevered posterior cranial shield system is diversion/deflection of the initial force directed at the head and neck to much less vulnerable and robust musculoskeletal structures. For linebackers, running backs and linemen, the vast majority of hits and contacts are initiated with the head in a relatively neutral (face forward) position relative to the torso. Skill position players' heads deviate from the neutral position by way of neck rotation much more frequently in order to dynamically locate the football, such as a wide receiver turning his head back to find the ball in the air to make a catch. The extremes of head and neck rotation, extension, and flexion are also required of defensive backs. Neck lateral bending (bending side-to-side) is not a common occurrence when a patient engages in contact, as the head and neck naturally assume a neutral and extended position prior and during physical engagement. Offensive and defensive skill position players require increased head range of motion, and thus less restriction from primary integrated protective equipment. As level of play progresses to advanced and elite football, players may customize their uncoupled cantilevered posterior cranial shield system to achieve a proper position specific balance between helmet range of motion and enhanced safety. In other words, cornerbacks and offensive lineman sustain different degrees of subconcussive repetitive head impacts, and also require different head ranges of motion for routine play demanded by their position.

According to the foregoing, provided herein is a modular system for protecting the head of a wearer from concussive injuries wherein the system is not applied to or donned by the wearer on the head. This modular system, as compared with conventional helmets, uncouples structural protective armament from the more vulnerable head and neck to less vulnerable anatomic regions of the torso to confer protection to both the face and head independent of an exclusive connection to the head. The primary benefits of such a structural uncoupling are diversion, deflection, dissipation, and distribution of the initial force directed at the head, neck, and spine to either much less vulnerable and robust musculoskeletal structures (chest and upper back/shoulders), or less vulnerable areas of the head/face. Employing this modular system, the head is no longer the primary and exclusive reception point for every force directed above the shoulders during play.

Figure 14:
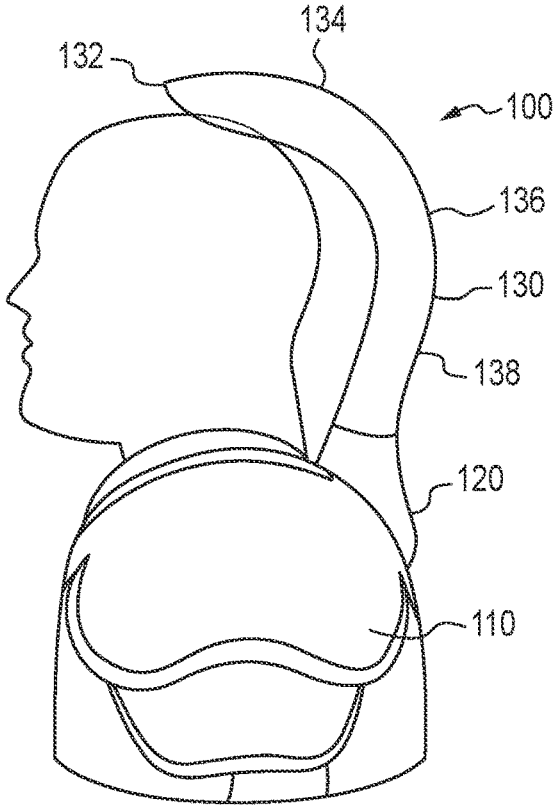
FIG. 14 shows a side view drawing of a first embodiment of the uncoupled cantilevered posterior cranial shield system, wherein the support garment is depicted as athletic shoulder pads.
Figure 15:
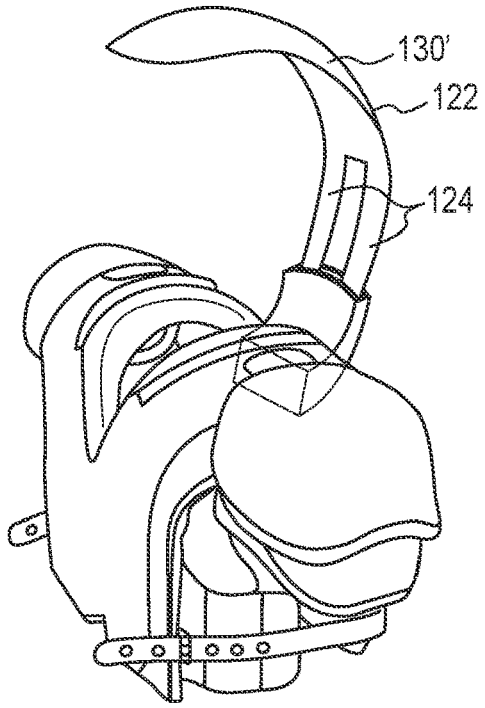
FIG. 15 shows a front perspective view drawing of another embodiment of the uncoupled cantilevered posterior cranial shield system, wherein the support garment is depicted as athletic shoulder pads.

Referring now to the drawings, FIG. 14 and FIG. 15, for example, show representative embodiments of the uncoupled cantilevered posterior cranial shield system 100 according to the disclosure. In some embodiments, the uncoupled cantilevered posterior cranial shield system 100 is principally connected at the upper back region to a support garment 110 (shown in an embodiment that is in the form of athletic shoulder pads) or integrated with the support garment. In the depicted embodiments, the support garment 110 is represented as athletic shoulder pads. It will be appreciated by one of ordinary skill in the art that a support garment that is suitable for a sport may vary, and thus as represented in FIG. 13A-13E, the support garment may be in the form of a harness (FIG. 13A) formed of one or more interconnected straps, such as for climbing, construction and other activities, or a chest protector (FIG. 13B), such as for hockey and other ice sports, or a fitted vest (FIG. 13C), such as for equestrian sports, or of a form fitting shirt (FIG. 13E) or a partial or whole body suit (FIG. 13D), such as for motor sports or skiing, or in the form of athletic shoulder pads, as shown variously in the drawings, or another garment or fitted wearable article that is suitable for donning by a wearer to securely attach an assembly that includes the uncoupled cantilevered posterior cranial shield. Accordingly, though the instant disclosure represents the support garment 110 as athletic shoulder pads for football, the embodiment is not intended to be limiting.

Referring again to the drawings, FIG. 14 shows an uncoupled cantilevered posterior cranial shield system 100 that includes a securement housing 120 connected to a support garment 110, and an attenuating cantilevered arch 130 attached to the securement housing 120, wherein the attenuating cantilevered arch 130 is configured to extend over a head of an individual wearing the support garment and the attenuating cantilevered arch 130 is free of force communicating persistent connection to a head of the wearer other than indirectly through the body of the wearer via support garment, for example, athletic shoulder pads. That is, the attenuating cantilevered arch 130 is not affixed to a wearer's head and is designed to generally not contact a wearer's head except in the event of extreme compression of the attenuating cantilevered arch 130 toward the head as further described herein. As used herein, "force communicating persistent connection" indicates a connection that is persistent and is capable of communicating force in its persistent state. By way of example for illustrative purposes, a slack line or chain would not be considered force communicating in its persistent state, even if the slack line or chain were capable of being tensioned as a result of intermittent stimuli; however, a tensioned line or chain would be considered force communicating in its persistent state, even if the tensioned line or chain were capable of becoming slack as a result of intermittent stimuli.

The securement housing 120 may be composed of any suitable material, including, but not limited to, polycarbonates, carbon fiber reinforced polymers, carbon fiber alloys, titanium, aramids, poly-paraphenylene terephthalamide, or combinations thereof. The securement housing 120 may be configured to be integrated with or attached to an upper back portion of the support garment 110. It may have force dissipating (shock absorbing) properties and translate upon contact in order to minimize any adverse influence upon the shoulder pad function.

The attenuating cantilevered arch 130 may be composed of any suitable material, including, but not limited to, polycarbonates, carbon fiber reinforced polymers, carbon steels, stainless steels, spring steels, carbon fiber alloys, titanium, aramids, poly-paraphenylene terephthalamide, composite materials, or combinations thereof.

The attenuating cantilevered arch 130 may include one or more visor shields 140, including, for example, one or both of lateral visor shield 142 and frontal visor shield 144 components, as shown in FIG. 11, attached to the attenuating cantilevered arch 130. A visor shield 140 may be flat or curved depending on the size, shape, and position. A visor shield 140 may be formed from any suitable material, including, but not limited to, translucent materials such as polycarbonate plastic. A visor shield 140 may further be coated to enhance low friction qualities in order to optimize contact mechanics during helmet-to-helmet engagements.

Referring again to FIG. 14 and FIG. 15, the attenuating cantilevered arch 130 is configured to extend toward the front of the wearer's head from its attachment point at the securement housing 120 and has a width dimension and a length dimension that may vary along its length to provide a shield that protects the brain case of a wearer's skull along a center line from at least the base of the skull to the frontal portion of the skull. The securement housing 120 is affixed to the support garment 110 to enable direction of impact force to the attenuating cantilevered arch 130 through the securement housing 120 for distribution and dissipation along the support garment 110 and the body of the wearer.

Figure 16:
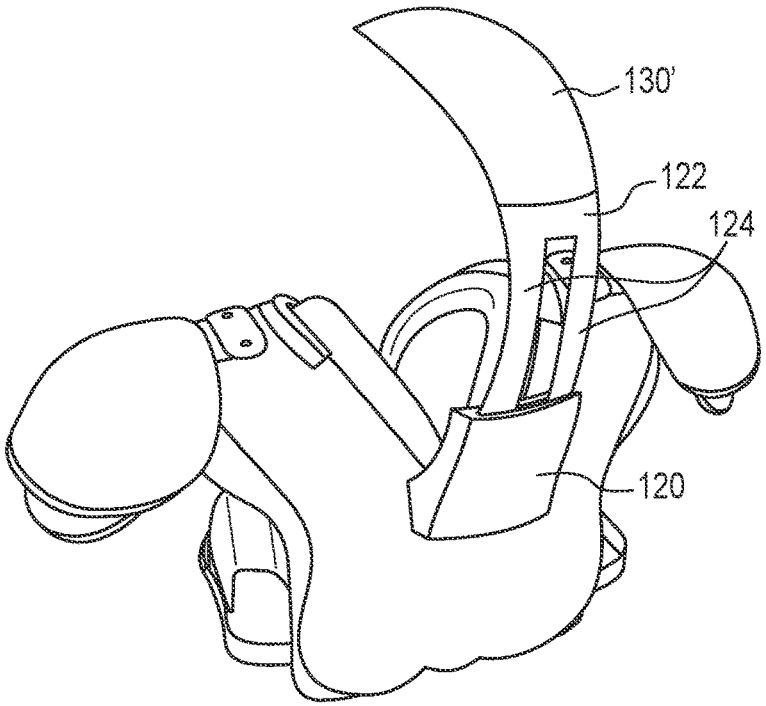
FIG. 16 shows a rear perspective view of the uncoupled cantilevered posterior cranial shield system shown in FIG. 15.
Figure 17:
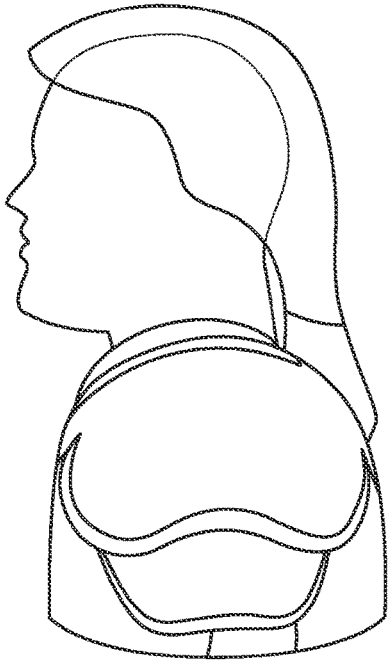
FIG. 17 shows a side view drawing of an yet another embodiment of the uncoupled cantilevered posterior cranial shield system, wherein the drawing includes a representative human figure and the support garment is depicted as athletic shoulder pads.
Figure 18:
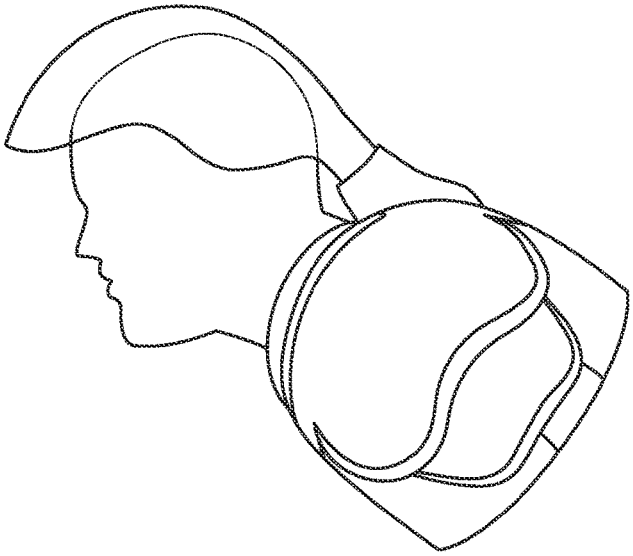
FIG. 18 shows a drawing of a representative human figure in the "football position" with the embodiment of the uncoupled cantilevered posterior cranial shield system shown in FIG. 17, wherein the representative human figure is shown with head/neck extended.
Figure 19:
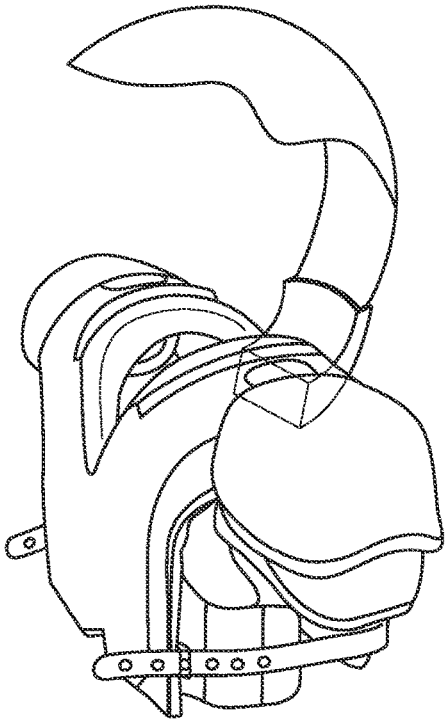
FIG. 19 shows a front perspective view drawing of the embodiment of the uncoupled cantilevered posterior cranial shield system shown in FIG. 17.
Figure 20:
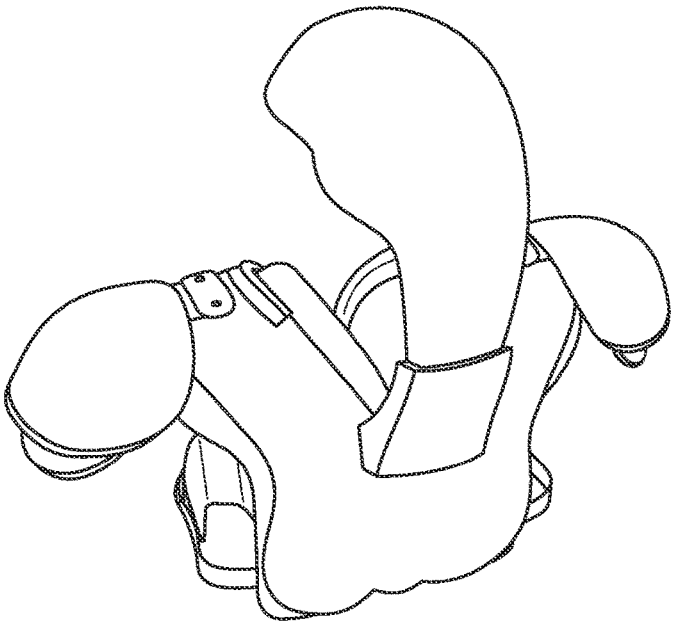
FIG. 20 shows a rear perspective view drawing of the embodiment of the uncoupled cantilevered posterior cranial shield system shown in FIG. 17.

Referring again to FIG. 14, an attenuating cantilevered arch 130 is characterized as having three segments, including a frontal shield portion 134 that terminates in an anterior edge 132, a parietal shield portion 136 and an occipital/neck shield portion 138. As shown in FIG. 14 FIG. 16, the attenuating cantilevered arch 130 has an arched shape with an interior surface that is concave and designed to generally follow the contour of a human skull, though the attenuating cantilevered arch 130 is not intended to contact a wearer's head. The portions of the attenuating cantilevered arch 130 that include the frontal shield portion 134 and at least the parietal shield portion 136 have a generally spherical contour to the interior concavity. In some embodiments, the interior surface of the occipital/neck shield portion 138 may be concave in shape (as shown in the embodiment shown in FIG. 14), with a generally spherical contour that may have a radius that is the same as or different than the radius of the interior surface of the frontal shield portion 134 and the parietal shield portion 136. In some other embodiments, the interior surface of the occipital/neck shield portion 138 may be generally rectilinear (as shown in the embodiment shown in FIG. 15 and FIG. 16).

Referring again to the drawings, FIG. 17-FIG. 20 show alternate views of another embodiment of an attenuating cantilevered arch 130 according to the disclosure. This embodiment includes a frontal shield portion 134 that terminates in an anterior edge 132, a parietal shield portion 136 and an occipital/neck shield portion 138, wherein each of the portions has a wider profile as compared with the embodiments shown in FIG. 14-FIG. 16. In the depicted embodiment, the frontal shield portion 134 and parietal shield portion 136 have a contoured shape that is similar to the shape of a conventional type of helmet and extend laterally to cover additional surface area of a wearer's head. It will be appreciated by one of skill in the art that the various embodiments of the attenuating cantilevered arch 130 may have any of a variety of shapes in one or more of the frontal shield portion 134, a parietal shield portion 136 and occipital/neck shield portion 138 and may cover greater or lesser portions of a wearer's skull. In such embodiments, the overall contour of the attenuating cantilevered arch 130 is designed to provide coverage suited to provide a receiving surface for receiving impact and directing force into the wearer's body and away from the head and neck without restricting the wearer's ability to swivel/turn their head within the apparatus.

Referring again to FIG. 15 and FIG. 16, the depicted embodiment of the uncoupled cantilevered posterior cranial shield system 100 includes a securement extension 122 to the securement housing 120, the securement extension 122 having an elongate generally "U" shape that includes a pair of insertion elements 124 which are secured to the securement extension 122. In some embodiments, the securement extension 122 alone or together with its pair of insertion elements 124 may be unitary with the securement housing 120, or the securement extension 122 and its pair of insertion elements 124 may be modular and comprise one or more parts that are connectable with the securement housing 120. For example, the insertion elements 124 of the securement extension 122 may be slidably insertable within the securement housing 120 along corresponding receiving channels or tracks within the securement hosing 120 to provide adjustable or slidable sizing in the height dimensions of the attenuating cantilevered arch 130 to fit a wearer.

In some embodiments, the securement housing 120 comprises one or more of force dampening structures and force dampening materials to further enhance the distribution and dissipation of impact force through the support garment 110 and the body of the wearer. Additional force dampening structures which may be utilized within the securement housing 120 or at the attachment interface between the securement housing 120 and the attenuating cantilevered arch 130 include, but are not limited to, force dissipating spacers, shock absorbing tracks, hinged spring shock absorbing connectors, torsional spring shock absorbing connectors, or combinations thereof. In one embodiment, the attenuating cantilevered arch 130 is attached to the securement housing 120 through one or more springs arranged and disposed to dampen collision force received by the attenuating cantilevered arch 130. In some particular embodiments, components of the securement housing 120 may be formed with force dampening materials such as, but not limited to, synthetic viscoelastic urethane polymers (such as SORBOTHANE, manufactured by Sorbothane, Inc. in Kent, Ohio).

Figure 21:
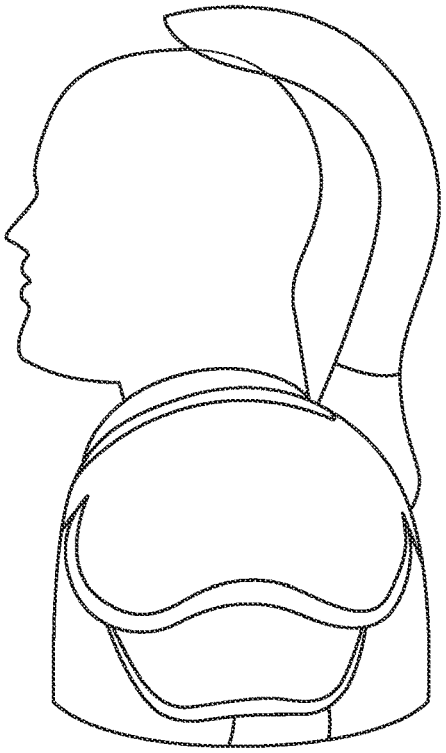
FIG. 21 shows the side view drawing shown in FIG. 14.
Figure 22:
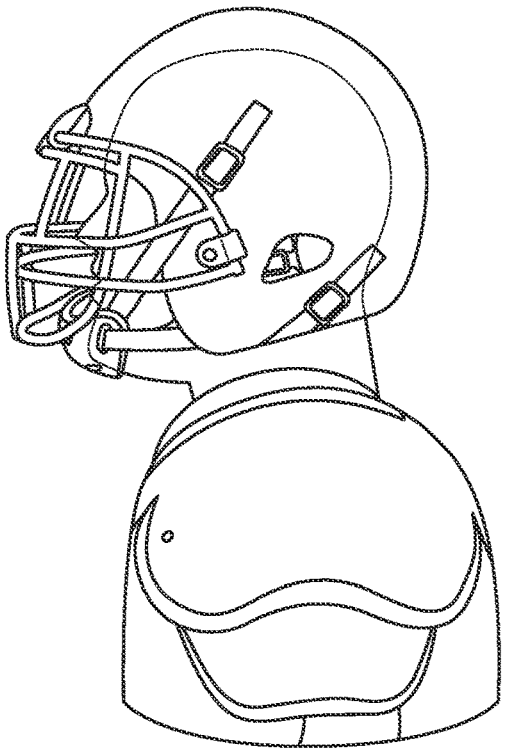
FIG. 22 shows a side view drawing of a representative human figure donned with a conventional football helmet and athletic shoulder pads.
Figure 23:
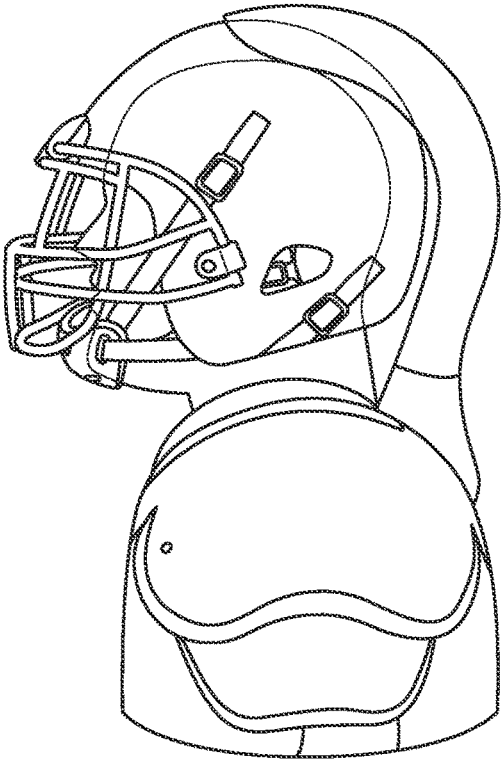
FIG. 23 shows the side view drawing shown in FIG. 14 including the conventional football helmet as shown in FIG. 22.

Referring now to FIG. 21 and FIG. 22, the drawings show the relative association of the attenuating cantilevered arch 130 as compared with a conventional helmet. As shown in FIG. 21, the attenuating cantilevered arch 130 covers only a portion of the wearer's head, and there is a gap between the body 136 of the attenuating cantilevered arch 130 and the wearer's head. Thus, as donned when the wearer is in a generally upright position, the front of the wearer's skull is not covered by the anterior end 132 of the frontal shield portion 134 of the attenuating cantilevered arch 130. It will be appreciated that when in use, the uncoupled cantilevered posterior cranial shield system 100 may be donned together with a conventional helmet to provide additional protection, in particular in the event of direct compressive force to the attenuating cantilevered arch 130 of the uncoupled cantilevered posterior cranial shield system 100. FIG. 23 shows an image of a human form wearing a conventional helmet together with the attenuating cantilevered arch 130. It should be appreciated that the overall shape and size of a conventional helmet significantly extends the profile of a wearer's head such that an attenuating cantilevered arch 130 must be sized in a manner that is much larger than is required when donned in the absence of a conventional helmet. It will be appreciated that there are benefits to be derived from wearing a padded and rigid helmet with an attenuating cantilevered arch 130 to provide supplemental protection in the event that the frontal shield portion 134 of the attenuating cantilevered arch 130 contacts a wearer's head on impact. In other embodiments, a streamlined helmet may be employed that includes close conforming padding elements without the bulky hard shell frame of a conventional helmet. It should be noted that whether with or without a supplemental head protector, such as a helmet or low profile helmet, the height of the uncoupled cantilevered posterior cranial shield system 100 can be set without any obstruction of head movement, accommodating complete head range of motion. As further described herein, the uncoupled cantilevered posterior cranial shield system 100 is adapted to "deploy" into a position to provide maximal protection to a wearer when their head/neck is flexed and when they are in the "football position" to provide protection to the cranium and crown. Since there is no effective lengthening of the wearer's neck, the uncoupled cantilevered posterior cranial shield system 100, once donned to be free of contact with the wearer's head, need not be adjusted in hits overall height along the axis of the wearer's spine.

Figure 24:
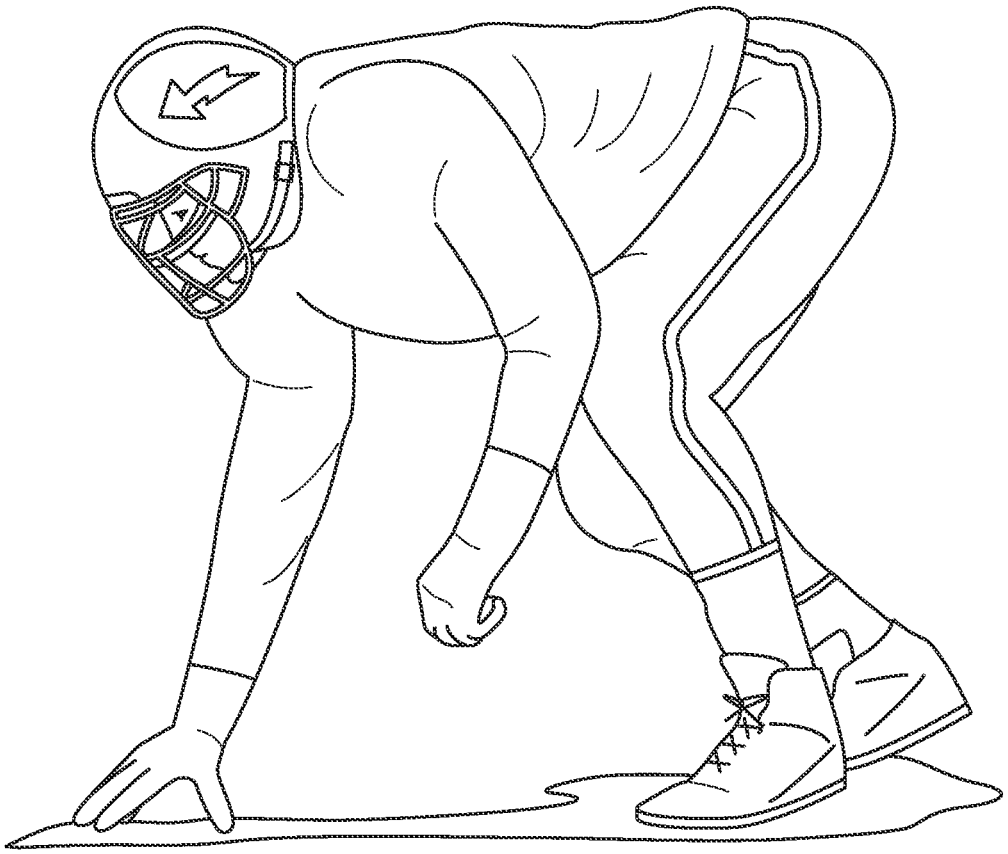
FIG. 24 shows a drawing of an American football player in the "football position" as referenced and described herein.

Referring again to the drawings, FIG. 24 shows an image of an American football player in the "football position." Reference to the "football position" describes the position that is most typically assumed by an American football player. It should be generally understood that American football is not played standing up (except for the quarterback position). Rather, American football is played in a generally crouched position wherein the player's head and neck are extended, the player is flexing/bending at the waist, and their knees are flexed. It is in this football position that almost 90% of football is played and it is the body position from which force contact is almost exclusively received and/or delivered, most typically to the upper torso and head. The inventor hereof has realized that conventional head gear, as addressed herein above, does not provide energy dissipative force away from the player's head and neck. Indeed, while a player is in the football position, conventional head gear is affixed in a generally static manner and any impact to the head gear necessarily results in direct travel of force to the player's head and neck and motion induced in the head gear is translated to the player's head and neck.

Figure 25:
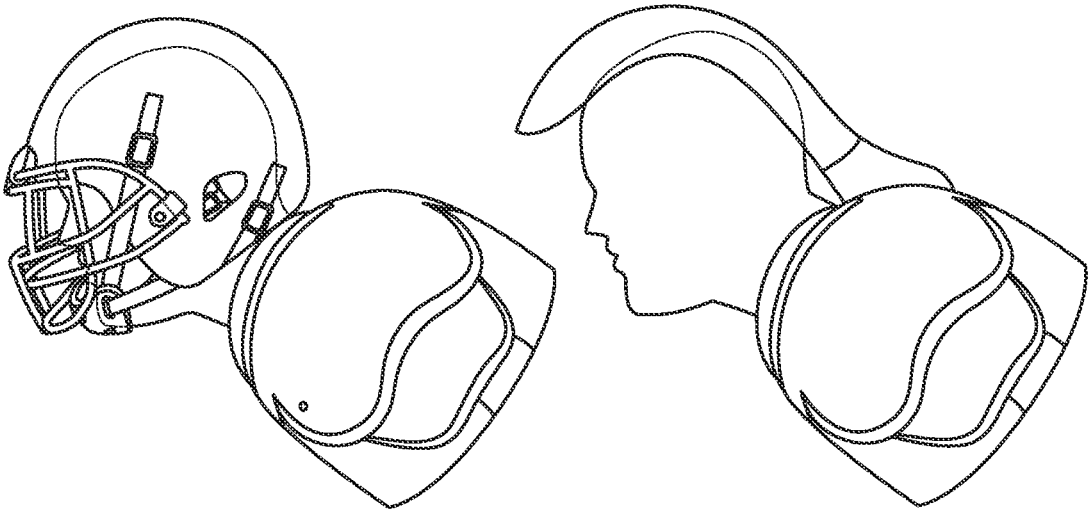
FIG. 25 shows drawings of representative human figures in the "football position" the image on the left donned with a conventional football helmet and athletic shoulder pads as shown in FIG. 22 and the figure on the right donned with the embodiment of the uncoupled cantilevered posterior cranial shield system shown in FIG. 14, wherein each representative figure is shown with head/neck extended.
Figure 26:
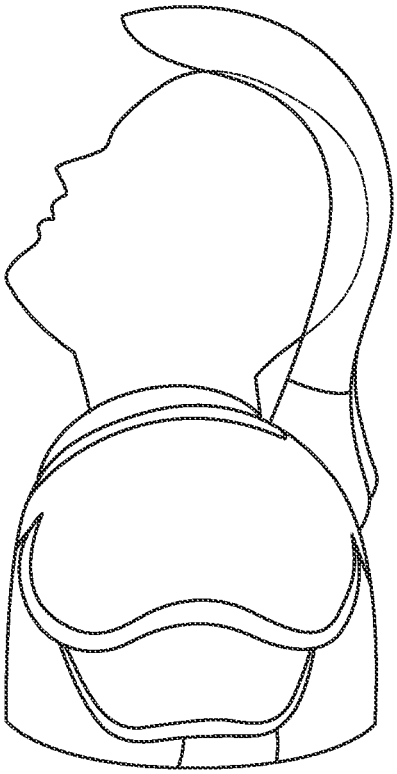
FIG. 26 shows a side view drawing with the embodiment of the uncoupled cantilevered posterior cranial shield system shown in FIG. 14, wherein the representative figure is shown with head/neck extended.
Figure 27:
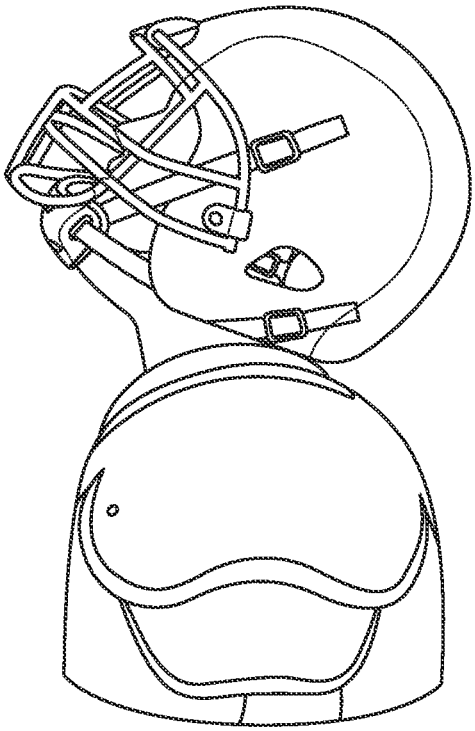
FIG. 27 shows a side view drawing as shown in FIG. 22, wherein the representative figure is shown with head/neck extended.
Figure 28:
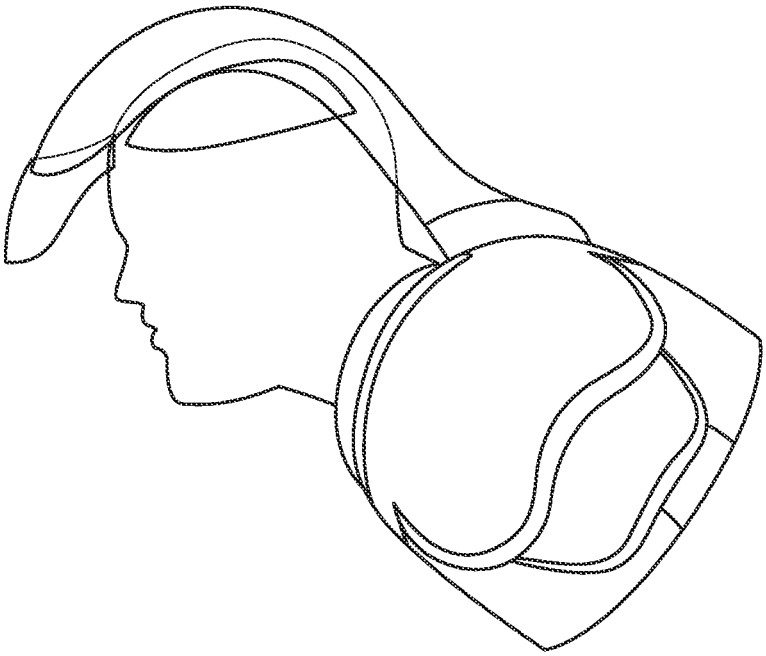
FIG. 28 shows an alternate embodiment of the uncoupled cantilevered posterior cranial shield system shown in FIG. 14 further comprising lateral and frontal visor shield attachments.
Figure 29A:
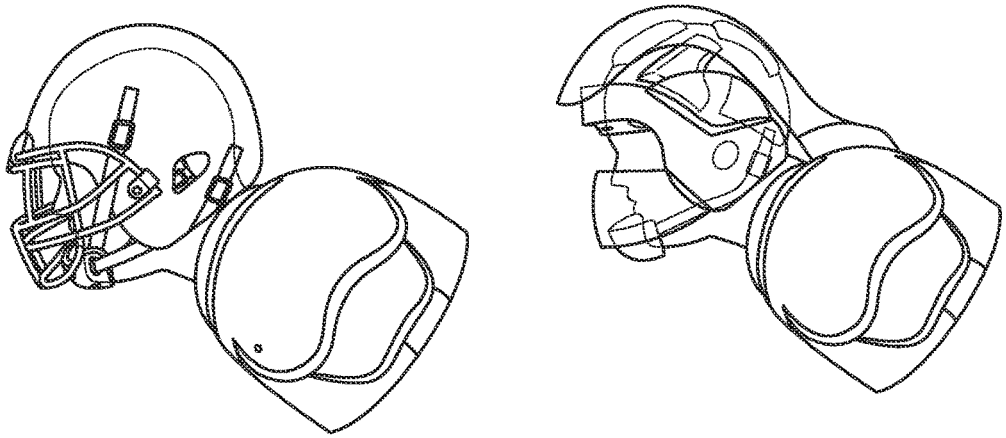
FIG. 29A shows representative human figures in the "football position" the image on the left donned with a conventional football helmet and athletic shoulder pads as shown in FIG. 22 and the figure on the right donned with the embodiment of the uncoupled cantilevered posterior cranial shield system shown in FIG. 14, wherein the figures are shown prior to impact.
Figure 29B:
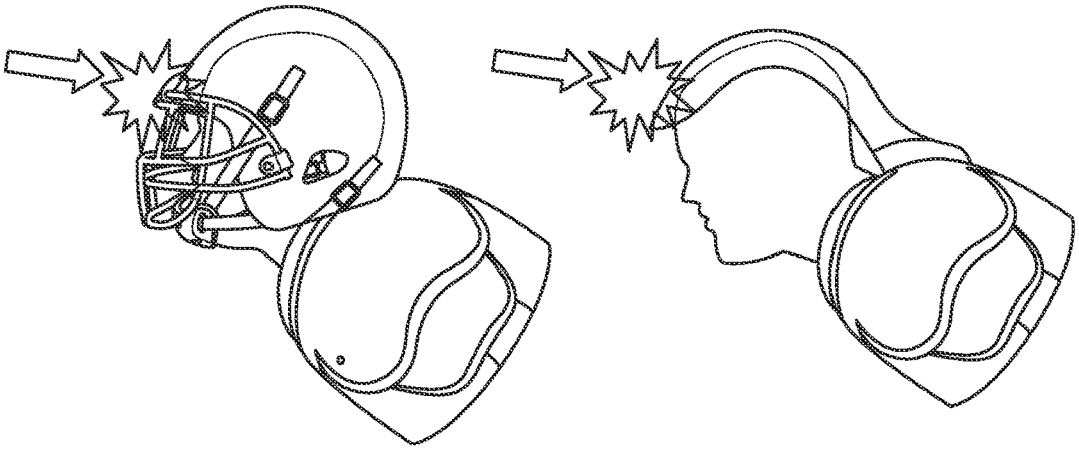
FIG. 29B shows representative human figures in the "football position" the image on the left donned with a conventional football helmet and athletic shoulder pads as shown in FIG. 22 and the figure on the right donned with the embodiment of the uncoupled cantilevered posterior cranial shield system shown in FIG. 14, wherein the figures are shown demonstrating linear force direction of impact to the respective helmet and uncoupled cantilevered posterior cranial shield system.
Figure 29C:
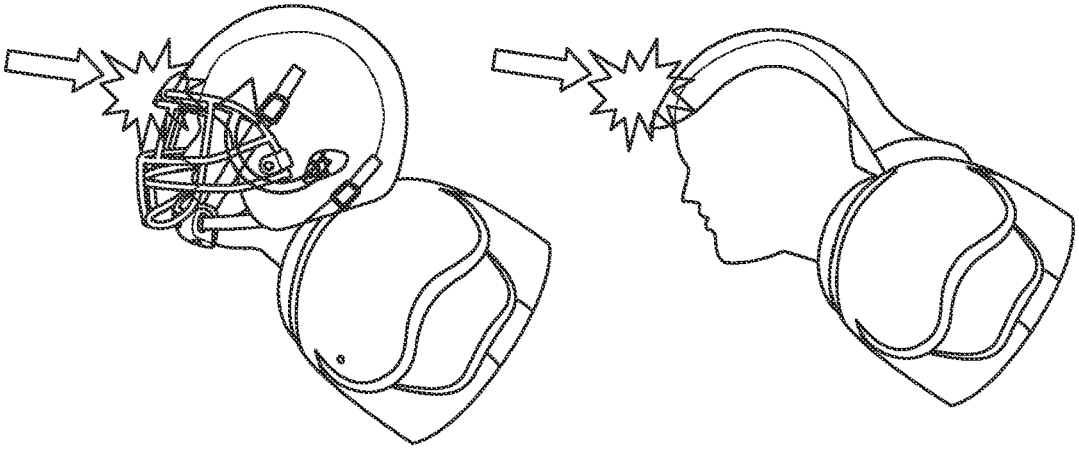
FIG. 29C shows representative human figures in the "football position" the image on the left donned with a conventional football helmet and athletic shoulder pads as shown in FIG. 22 and the figure on the right donned with the embodiment of the uncoupled cantilevered posterior cranial shield system shown in FIG. 14, wherein the figures are shown demonstrating liner force direction of impact to the respective helmet and uncoupled cantilevered posterior cranial shield system and effective rotational force on the helmeted head on the left.

The inventive system, which includes the novel attenuating cantilevered arch 130 adjusts its position as the player's position changes. Referring again to the drawings, for example, FIG. 21, shows that the attenuating cantilevered arch 130 generally extends over all or at least a portion of the wearer's crown, when the player is in a neutral position with the neck neutral (neither flexed nor extended). And referring to FIG. 25, right side image, the attenuating cantilevered arch 130 deploys to cover the player's crown and frontal cranium when the player assumes the football position. Additional illustrative views showing the relative protection provided by the attenuating cantilevered arch 130 as compared with a conventional helmet are shown in FIG. 16-FIG. 28. Referring again to FIG. 25, it should be appreciated that when the player's head is extended while wearing a conventional helmet (left) the rear of the helmet hits and interferes with the player's back. In contrast, the uncoupled cantilevered posterior cranial shield system 100 is deployed to provide more coverage of the head when the body assumes the football position, conferring protection of the critical frontal and crown regions of the head relative to the standing-up non-playing position. Head and neck lateral flexion (bending) and rotation (full head range of motion) are permitted with the HAALO, and force mitigation of deleterious rotational and angular forces are reduced at the level of the brain due to force conduction and dissipation by the HAALO into the shoulders/upper back. This concept is illustrated in each of panels A-C in FIG. 29. Additionally, there is better stabilization of the cervical spine due to this force diversion. The focus of direct linear head impacts is redirected, transforming the focal intensity of an impact 'below the brain' to the connection at the low rear helmet. Without being bound by theory, it is believed that this embodiment attenuates direct impact forces and converts them to a more manageable lower intensity angular force directed away from or below the brain, and temporally permitting the neck musculature to offer improved head stabilization for force mitigation.

In accordance with the various embodiments, disclosure provides:

An uncoupled cantilevered posterior cranial shield system, comprising:

a support garment, an securement housing attached to the support garment; and an attenuating cantilevered arch attached to the securement housing.

In some embodiments of the uncoupled cantilevered posterior cranial shield system, the yoke is composed of a material selected from the group consisting of polycarbonates, carbon fiber reinforced polymers, carbon fiber alloys, titanium, aramids, poly-paraphenylene terephthalamide, and combinations thereof.

In some embodiments of the uncoupled cantilevered posterior cranial shield system, the yoke is configured to be integrated with or attached to an upper back portion of the athletic shoulder pad.

In some embodiments of the uncoupled cantilevered posterior cranial shield system, the attenuating cantilevered arch is composed of a material selected from the group consisting of carbon steels, stainless steels, polycarbonates, carbon fiber reinforced polymers, carbon fiber alloys, titanium, aramids, poly-paraphenylene terephthalamide, composite materials, and combinations thereof.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, devices and components, alternatives as to form, fit and function, and so on) may be described herein, such descriptions are not intended to be a complete or exhaustive list of available alternative embodiments, whether presently known or later developed.

Those skilled in the art may readily adopt one or more of the inventive aspects, concepts and features into additional embodiments and uses within the scope of the general inventive concepts, even if such embodiments are not expressly disclosed herein. Additionally, even though some features, concepts and aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated.

Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A protective helmet, comprising:

an energy dissipative assembly comprising:

a conforming protective base adapted to directly contact and conform to a corresponding bony anatomical region of a wearer's head, wherein the bony anatomical region is defined by frontal, left and right zygomatic, left and right temporal and occipital skull bones, the conforming protective base comprising:

at least one rigid frontal segment, rigid left and right side segments, and at least one rigid occipital segment, each segment comprising a deformation resistant material;

a supported flexible suspended crown having interior and exterior surfaces, an apex region, a frontal region extending generally forwardly and downwardly from the apex region, left and right side regions extending generally downwardly and laterally from the apex region, and a rear region extending generally rearwardly and downwardly from the apex region, the supported flexible suspended crown adapted to be affixed to the conforming protective base, and configured to define a gap separating substantially all of the interior surface of the supported flexible suspended crown from contact with a corresponding anatomical crown region of the wearer when the helmet is donned by the wearer, wherein the anatomical crown region is defined by frontal, parietal, left and right sphenoid, left and right temporal, and occipital skull bones, the supported flexible suspended crown comprising:

a plurality of cantilevered members, each cantilevered member having a fixed end affixed to the conforming protective base and a cantilevered end that is free and extends toward the apex region of the crown, each one of the plurality of cantilevered members comprising a compliant energy dissipating material that, when impacted, undergoes deformation to an extent that is greater than deformation, when impacted, of the deformation resistant material of the conforming protective base; and a harness system affixed to the conforming protective base, the harness system comprising at least one contoured band that contacts the wearer's head when the helmet is donned.

2. The protective helmet according to claim 1, wherein the conforming protective base supports the helmet on the wearer's head when donned such that energy from an impact to the supported flexible suspended crown is dissipated, at least partially, by deformation of the plurality of cantilevered members of the supported flexible suspended crown, transmission through the plurality of cantilevered members to the conforming protective base, or a combination thereof.

3. The protective helmet according to claim 1, wherein the conforming protective base is continuous.

4. The protective helmet according to claim 1, wherein the conforming protective base has at least one discontinuity.

5. The protective helmet according to claim 1, wherein the conforming protective base comprises a fixator.

6. The protective helmet according to claim 5, wherein the fixator comprises a latch.

7. The protective helmet according to claim 1, the supported flexible suspended crown further comprising a flexible skin that interconnects at least two of the plurality of cantilevered members.

8. The protective helmet according to claim 1, wherein at least one of the plurality of cantilevered members is configured to move independently of another of the plurality of cantilevered members.

9. The protective helmet according to claim 1, wherein the said fixed end of at least one of the plurality of cantilevered members is affixed at a position that is configured to be sub-cranial.

10. The protective helmet according to claim 1, wherein the conforming protective base and supported flexible suspended crown are separate and affixable together and are adapted to be independently donned in sequence by a wearer, the sequence including donning the conforming protective base followed by donning the supported flexible suspended crown, each of the conforming protective base and supported flexible suspended crown comprising corresponding engagement features.

11. The protective helmet according to claim 10, wherein the helmet includes one or more of a chin strap, face guard, and visor affixed or affixable to the helmet.

12. The protective helmet according to claim 1, wherein the conforming protective base and supported flexible suspended crown are affixed together and adapted to be donned as a unitary structure by a wearer.

13. The protective helmet according to claim 1, wherein the helmet is a football helmet.

14. The protective helmet according to claim 1, wherein the plurality of cantilevered members comprises more than two cantilevered members.

15. A protective helmet comprising:

an energy dissipative assembly comprising:

a conforming protective base adapted to directly contact and conform to a corresponding bony anatomical region of a wearer's head, wherein the bony anatomical region is defined by frontal, left and right zygomatic, left and right temporal and occipital skull bones, the conforming protective base comprising:

at least one rigid frontal segment, rigid left and right side segments, and at least one rigid occipital segment, each segment comprising a deformation resistant material;

a supported flexible suspended crown having interior and exterior surfaces, an apex region, a frontal region extending generally forwardly and downwardly from the apex region, left and right side regions extending generally downwardly and laterally from the apex region, and a rear region extending generally rearwardly and downwardly from the apex region, the supported flexible suspended crown adapted to be affixed to the conforming protective base, and configured to define a gap separating substantially all of the interior surface of the supported flexible suspended crown from contact with a corresponding anatomical crown region of the wearer when the helmet is donned by the wearer, wherein the anatomical crown region is defined by frontal, parietal, left and right sphenoid, left and right temporal, and occipital skull bones, the supported flexible suspended crown comprising:

a plurality of cantilevered members, each cantilevered member having a fixed end affixed to the conforming protective base and a cantilevered end that is free, at least one of the plurality of cantilevered members affixed to the conforming protective base extending to an opposed cantilevered end that is in contact with or overlaps an opposed cantilevered end of another one of the cantilevered members, each one of the plurality of cantilevered members comprising a compliant energy dissipating material that, when impacted, undergoes deformation to an extent that is greater than deformation, when impacted, of the deformation resistant material of the conforming protective base; and a harness system affixed to the conforming protective base, the harness system comprising at least one contoured band that contacts the wearer's head when the helmet is donned.

16. The protective helmet according to claim 15, wherein the plurality of cantilevered members comprises more than two cantilevered members.

17. A protective helmet, comprising:

a conforming protective base adapted to directly contact and conform to a corresponding bony anatomical region of a wearer's head, wherein the bony anatomical region is defined by frontal, left and right zygomatic, left and right temporal and occipital skull bones;

a harness system affixed to the conforming protective base, the harness system comprising at least one contoured band that contacts the wearer's head when the helmet is donned; and a helmet crown arrangement connected at one end to the conforming protective base, the helmet crown arrangement extending to at least one cantilevered member having a fixed end affixed to the conforming protective base and a cantilevered end that is free and extends toward an apex region of the crown arrangement; the at least one cantilevered member defining at least a portion of a crown arrangement corresponding to but separated by a predetermined distance from a corresponding anatomical crown region of the wearer when the helmet is donned by the wearer, wherein the anatomical crown region is defined by frontal, parietal, left and right sphenoid, left and right temporal, and occipital skull bones.

18. The protective helmet according to claim 17, wherein the conforming protective base supports the helmet on the wearer's head when donned such that energy from an impact applied to a cantilevered end of the at least one cantilevered member of the helmet crown arrangement is dissipated, at least partially, by deformation of the at least one cantilevered member, transmission through the at least one cantilevered member to the conforming protective base, or a combination thereof.

19. The protective helmet according to claim 17, wherein the at least one cantilevered member comprises more than two cantilevered members.

20. A protective helmet, comprising:

a conforming protective base adapted to directly contact and conform to a corresponding bony anatomical region of a wearer's head, wherein the bony anatomical region is defined by frontal, left and right zygomatic, left and right temporal and occipital skull bones;

a helmet crown arrangement connected at one end to the conforming protective base, the helmet crown arrangement extending to a plurality of cantilevered members each having a fixed end affixed to the conforming protective base and a cantilevered end that is free and extends toward an apex region of the crown arrangement; at least one of the plurality of cantilevered members forming the crown arrangement being complementarily contoured and spaced away by a predetermined distance from a corresponding anatomical crown region of the wearer when the helmet is donned by the wearer, wherein the anatomical crown region is defined by frontal, parietal, left and right sphenoid, left and right temporal, and occipital skull bones;

a harness system affixed to the conforming protective base and spaced away from the helmet crown arrangement, the harness system comprising at least one contoured band that contacts the wearer's head when the helmet is donned;

wherein the conforming protective base supports the helmet on the wearer's head when donned such that energy from an impact applied to a cantilevered portion of the at least one cantilevered member of the helmet crown arrangement is dissipated, at least partially, by deformation of the at least one cantilevered member, transmission through the at least one cantilevered member to the conforming protective base, or a combination thereof.

21. The protective helmet according to claim 20, the crown arrangement further comprising a flexible skin that interconnects at least two of the plurality of cantilevered members.

22. The protective helmet according to claim 20, wherein the plurality of cantilevered members comprises more than two cantilevered members.

* * * * *